US009039030B2

(12) United States Patent
Chickering-Ayers

(10) Patent No.: US 9,039,030 B2
(45) Date of Patent: May 26, 2015

(54) CONVERTIBLE SKI SYSTEMS HAVING TOE BINDING MOUNTS AND ASSOCIATED QUICK-RELEASE LOCKING MECHANISMS

(76) Inventor: Lars Chickering-Ayers, Plainfield, VT (US)

( * ) Notice: Subject to any disclaimer, the term of this patent is extended or adjusted under 35 U.S.C. 154(b) by 164 days.

(21) Appl. No.: 13/596,183

(22) Filed: Aug. 28, 2012

(65) Prior Publication Data

US 2013/0056960 A1 Mar. 7, 2013

Related U.S. Application Data

(60) Provisional application No. 61/528,309, filed on Aug. 29, 2011.

(51) Int. Cl.

| | |
|---|---|
| ***A63C 9/00*** | (2012.01) |
| ***A63C 9/086*** | (2012.01) |
| *A63C 9/084* | (2012.01) |
| *A63C 9/085* | (2012.01) |

(52) U.S. Cl.

CPC ..... *A63C 9/003* (2013.01); *A63C 9/006* (2013.01); *A63C 9/0844* (2013.01); *A63C 9/08521* (2013.01); *A63C 9/086* (2013.01); *A63C 2203/06* (2013.01)

(58) Field of Classification Search

CPC ..... A63C 9/003; A63C 9/086; A63C 9/16; A63C 9/20

USPC ..... 280/11.3, 11.31, 613, 614

See application file for complete search history.

(56) References Cited

U.S. PATENT DOCUMENTS

| | | | | |
|---|---|---|---|---|
| 4,500,108 | A * | 2/1985 | Johnson, III | 280/614 |
| 4,531,309 | A * | 7/1985 | Vandenberg et al. | 36/117.2 |
| 2009/0071019 | A1 * | 3/2009 | Pupko | 33/6 |

OTHER PUBLICATIONS

Undated photograph of Head Mojo 18 Alpine Binding (Admitted Prior Art).

Undated photograph of Look Pivot 18 Alpine Binding (Admitted Prior Art).

Undated photograph of Dynfit TLT Speed Touring Binding (Admitted Prior Art).

Undated photograph of Marker Duke Alpine Touring Binding (Admitted Prior Art).

Print out of Web page entitled MFD Alltime Rossignol/Look System, http://runmfd.com/mfd-alltime-rossignal-look-system/, dated 2011 (6 pages).

Print out of McMaster-Carr Internet Catalog, www.mcmaster.com, (4 pages) (Admitted Prior Art).

* cited by examiner

*Primary Examiner* — Hau Phan
*Assistant Examiner* — Bryan Evans
(74) *Attorney, Agent, or Firm* — Myers Bigel Sibley & Sajovec, P.A.

(57) ABSTRACT

A ski system includes a ski, a heel binding provided on an upper surface of the ski, a toe binding mount provided on the upper surface of the ski forward of the heel binding, a toe binding releasably mounted to the toe binding mount, and a quick-release locking mechanism for locking the toe binding to the toe binding mount. The quick-release locking mechanism is configured for release by hand.

20 Claims, 27 Drawing Sheets

CONVERTIBLE SKI SYSTEMS HAVING TOE BINDING MOUNTS AND ASSOCIATED QUICK-RELEASE LOCKING MECHANISMS

CROSS-REFERENCE TO RELATED APPLICATION

The present application claims priority under 35 U.S.C. 119(e) to U.S. Provisional Application Ser. No. 61/528,309, filed Aug. 29, 2011, the entire content of which is incorporated herein by reference as if set forth fully herein.

FIELD OF THE INVENTION

The present invention relates to ski equipment and, more particularly, to ski systems that include a first toe binding that can be quickly and easily replaced with a second toe binding.

BACKGROUND

Ski bindings are devices that are used to mount a ski boot to an upper surface of a ski in a releasable manner. Typically, a ski binding is a two piece structure that includes a front or "toe" binding that locks the toe of the ski boot in place on the ski and a rear or "heel" binding that locks the heel of the ski boot in place on the ski. Ski bindings are designed to release the front of the ski boot, the rear of the ski boot, or both at once when certain levels of stress are applied in order to reduce the risk of injury in the event of accidental falls that apply forces sufficient to endanger the leg or joints of the skier. The toe binding and the heel binding may each include, for example, a spring-biased jaw that holds the respective toe or heel of the ski boot in place. The compression of the spring of each jaw may be adjustable to assure an appropriate pressure limit for the release of the ski boot.

Both downhill and touring ski bindings are known in the art. Downhill ski bindings are used for skiing down mountains. Consequently, downhill ski bindings are designed to lock the ski boot tightly in place such that the ski boot will not move within the binding except when subjected to significant forces that pop the ski boot out of one or both of the toe binding and/or the heel binding. In contrast, touring ski bindings are designed for cross-country skiing and/or for ascending mountains. Thus, touring ski bindings are typically lightweight and free pivoting.

FIG. 1 is a perspective view of a conventional ski system 10. FIG. 2 is a perspective view of the ski system 10 of FIG. 1 with a ski boot 50 mounted to the ski.

Referring to FIGS. 1 and 2, the ski system 10 comprises a ski 20 that has a toe binding 30 and a heel binding 40 mounted thereon. As shown in FIG. 1, the toe binding 30 is mounted forward of the heel binding 40, with both the toe binding 30 and the heel binding 40 mounted on an upper surface 22 of ski 20. As shown in FIG. 2, the heel binding 40 includes a locking mechanism 42 that may be used to tightly lock the ski boot 50 in place between the toe binding 30 and the heel binding 40.

SUMMARY

Pursuant to embodiments of the present invention, ski systems are provided that include a ski having a top surface and a bottom surface. A heel binding and a toe binding mount are mounted on an upper surface of the ski, with the toe binding mount being mounted forwardly of the heel binding. A toe binding is releasably mounted to the toe binding mount. Finally, a quick-release locking mechanism is provided for locking the toe binding to the toe binding mount, where the quick-release locking mechanism is configured for release by hand.

In some embodiments, the toe binding includes a support plate that is configured to mate with the toe binding mount, and the toe binding mount is configured to slidably receive the support plate. The toe binding mount may include a first sidewall that extends upwardly above the ski and a first lip that extends inwardly from the first sidewall, and a second sidewall that extends upwardly above the ski and a second lip that extends inwardly from the second sidewall toward the first sidewall, the first and second sidewalls being generally opposed from each other. In some embodiments, the first and second sidewalls may be generally parallel to each other, while in other embodiments the first and second sidewalls may be angled with respect to each other.

In some embodiments, the quick-release locking mechanism may comprise a lock pin that is received within apertures in the first and second sidewalls, wherein the lock pin is configured to hold the support plate within the toe binding mount. In other embodiments, the quick-release locking mechanism may comprise a rotatable stop. In still other embodiments, the quick-release locking mechanism may comprise at least one hand-activated spring clip. In still other embodiments, the toe binding mount may comprise a plurality of bolts that are partially inserted into the upper surface of the ski, and the toe binding may be mounted on a support plate that includes a plurality of apertures that receive respective ones of the bolts.

Pursuant to further embodiments of the present invention, ski systems are provided that include a ski having a top surface and a bottom surface, a heel binding provided on an upper surface of the ski, a toe binding mount provided on the upper surface of the ski forward of the heel binding. These ski systems may also include a first free-pivoting toe binding that is suitable for use in ascending mountains and a second alpine toe binding that is suitable for descending mountains, where both the first and second toe bindings are configured to be releasably mounted to the toe binding mount. The ski systems also include a quick-release locking mechanism for locking the toe binding to the toe binding mount, where the quick-release locking mechanism includes at least one release mechanism that is configured for release by hand.

In some embodiments, the release mechanism may comprise a removable lock pin. In other embodiments, the release mechanism may comprise at least one spring clip. The first free-pivoting toe binding may be mounted on a first support plate, and the second alpine toe binding may be mounted on a second support plate, where the first and second support plates are configured to be received by the toe binding mount. In some embodiments, the first support plate may mount a jaw of the first free-pivoting toe binding farther forward on the ski than the second support plate mounts a jaw of the second alpine toe binding. Moreover, each of the first and second support plates may be each slidably received within a channel of the toe binding mount. The first support plate may include a plurality of apertures that are aligned with a plurality of apertures included on a bottom surface of the first free-pivoting toe binding. Additionally, the heel binding may include a climbing bail.

Pursuant to still further embodiments of the present invention, methods of configuring a ski are provided in which a first toe binding is inserted within a toe binding mount that extends from a top surface of the ski. The first toe binding may then be locked to the toe binding mount using a quick-release locking mechanism. Thereafter, the quick-release locking mechanism may be released by hand, and the first toe binding may be removed from the toe binding mount. Finally, a second toe binding may be inserted within the toe binding mount and locked to the toe binding mount using the quick-release locking mechanism.

In some embodiments, the first toe binding may be mounted on a first support plate and the second toe binding may be mounted on a second support plate, where the toe binding mount is configured to slidably receive the first and second support plates. The toe binding mount may include a first sidewall that extends upwardly above the ski and a first lip that extends inwardly from the first sidewall, and a second sidewall that extends upwardly above the ski and a second lip that extends inwardly from the second sidewall toward the first sidewall.

DETAILED DESCRIPTION

Pursuant to embodiments of the present invention, ski systems are provided that include multiple toe bindings and a toe binding mount that includes a quick-release locking mechanism that allows for the quick and simple exchange of one toe binding for another toe binding. With these ski systems, a skier may climb up a hill or mountain using for example, a lightweight, free-pivoting touring toe binding that is designed for cross-country skiing or climbing, and may then quickly and easily swap out the touring toe-binding for an alpine toe binding that is designed for down-hill skiing. The exchange of toe bindings is facilitated by the provision of a toe binding mount that includes a quick-release locking mechanism. The quick-release locking mechanism of the toe binding mount may be operated by hand, and may allow the toe bindings to be inserted and/or removed very quickly from the toe binding mount.

In some embodiments, the toe binding mount may slidably receive a support plate of the toe binding, and a quick-release locking mechanism may be used to lock the support plate in place within the toe binding mount by preventing the support plate from sliding back out of the toe binding mount. In other embodiments, the quick-release locking mechanism may comprise one or more snap clips that may be hand activated and hand-released that may be used to lock the support plate in place within the toe binding mount. In some embodiments, the toe binding mount may be designed to mount different types of toe bindings at different distances from the heel binding.

Embodiments of the present invention will now be described in greater detail with reference to the attached figures, which disclose several exemplary embodiments of the present invention. As used herein, the term "longitudinal" refers to directions that are generally parallel to a line running down the middle of the top surface of a ski from the back of the ski to the front of the ski. The term "transverse" refers to directions that are generally parallel to a line along the top surface of the ski that is orthogonal to the longitudinal direction.

Figure 1:
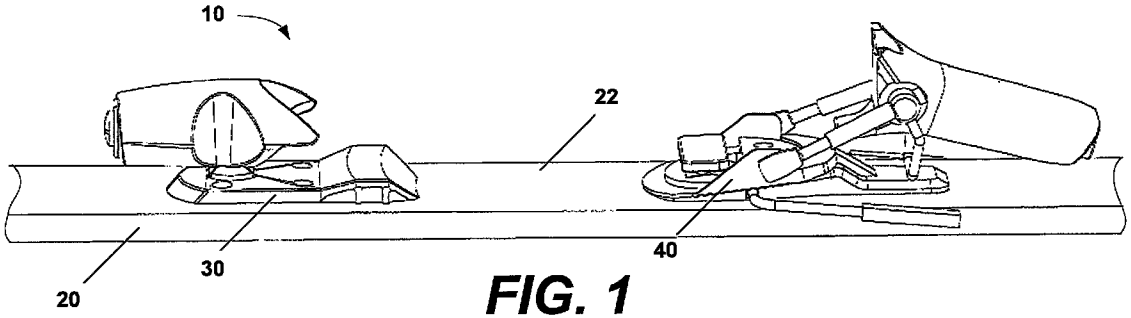
FIG. 1 is a side, perspective view of a conventional ski system that comprises a ski with a toe binding and a heel binding mounted thereon.
Figure 2:
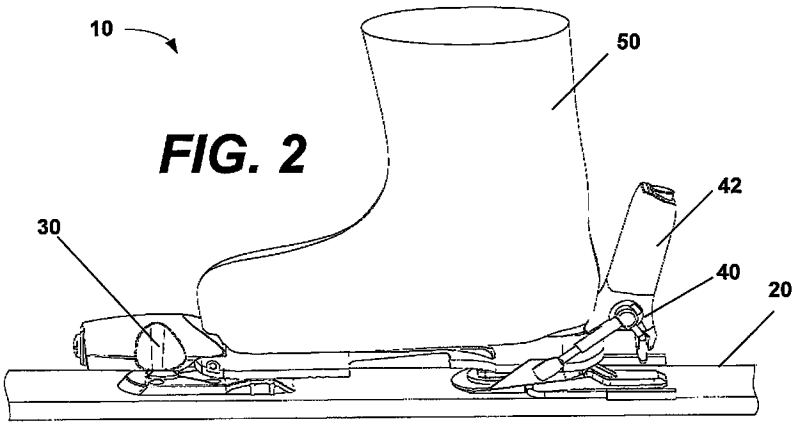
FIG. 2 is a side, perspective view of the conventional ski system of FIG. 1 with a ski boot mounted thereto.
Figure 3:
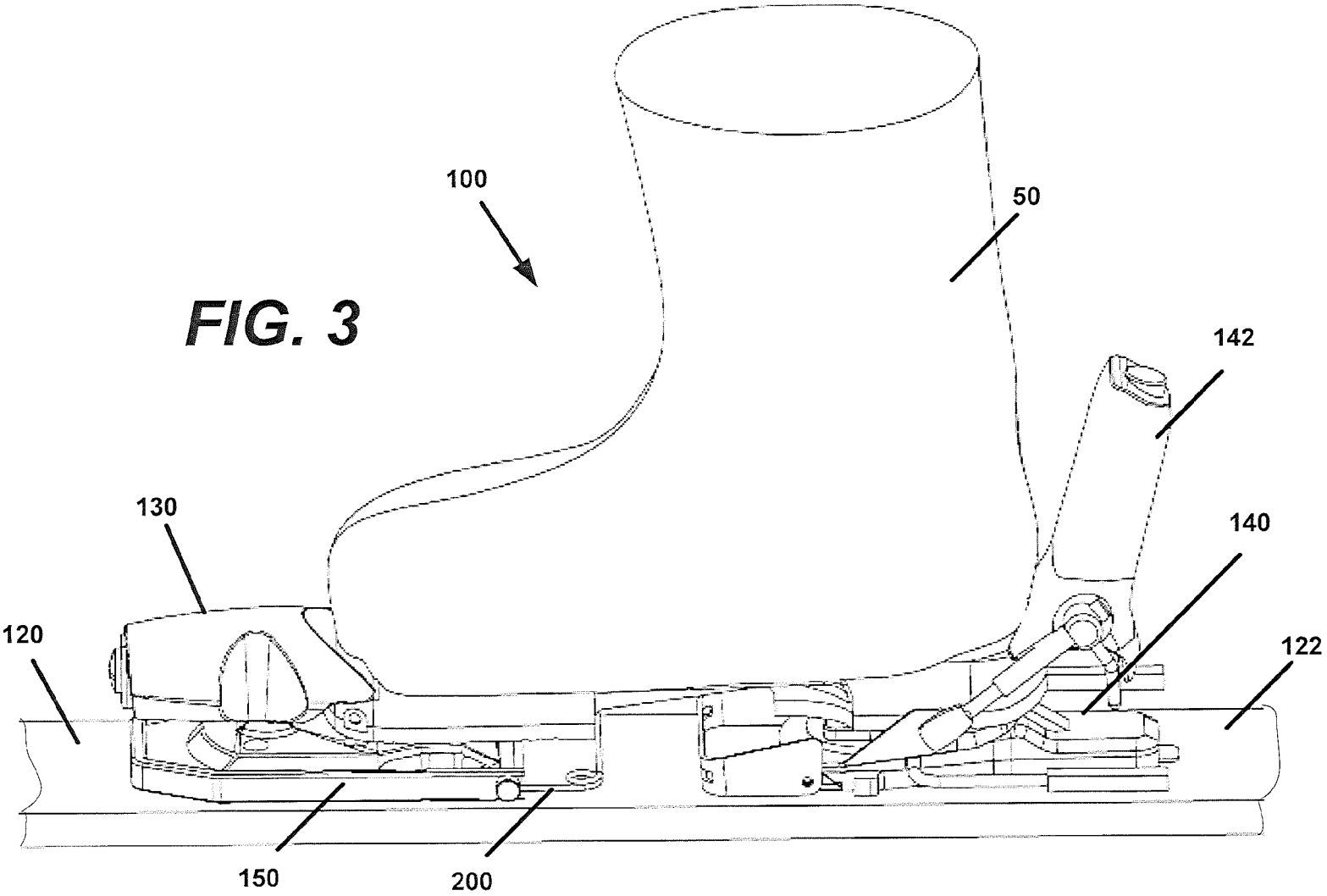
FIG. 3 is a side, perspective view of a ski system according to embodiments of the present invention.
Figure 4A:
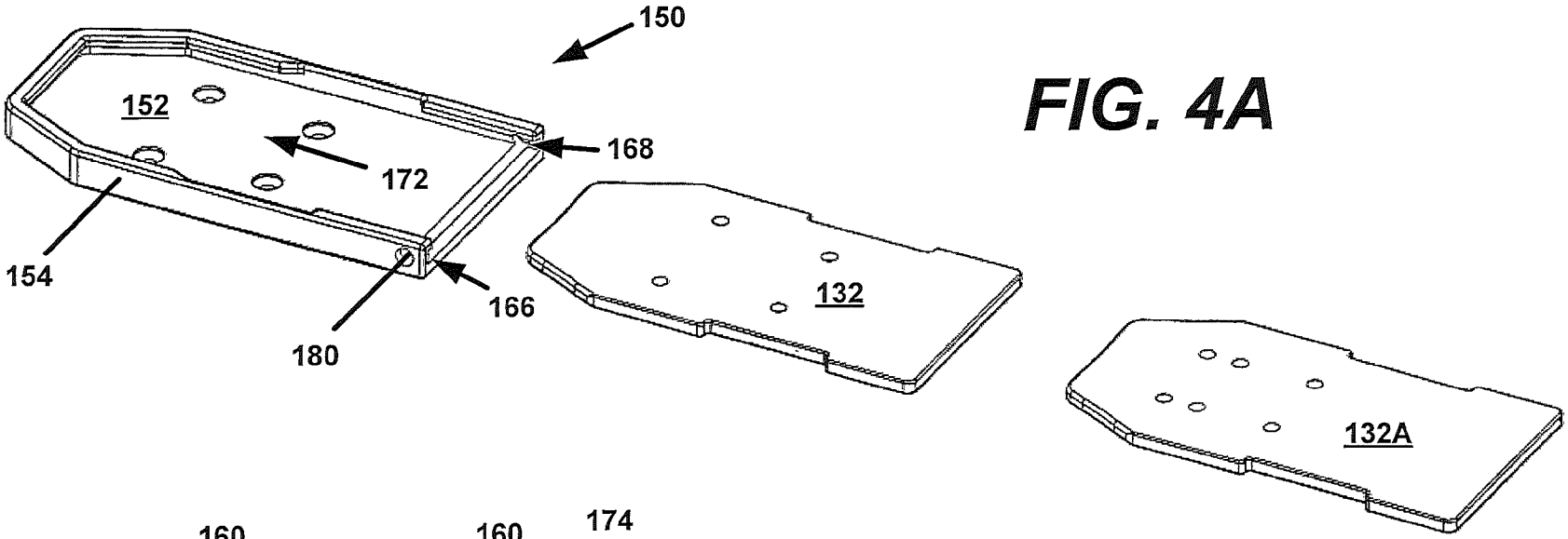
FIG. 4A is a perspective view of a toe binding mount of the ski system of FIG. 3 that illustrates how two different binding support plates may be slidably received within the toe binding mount.
Figure 4E:
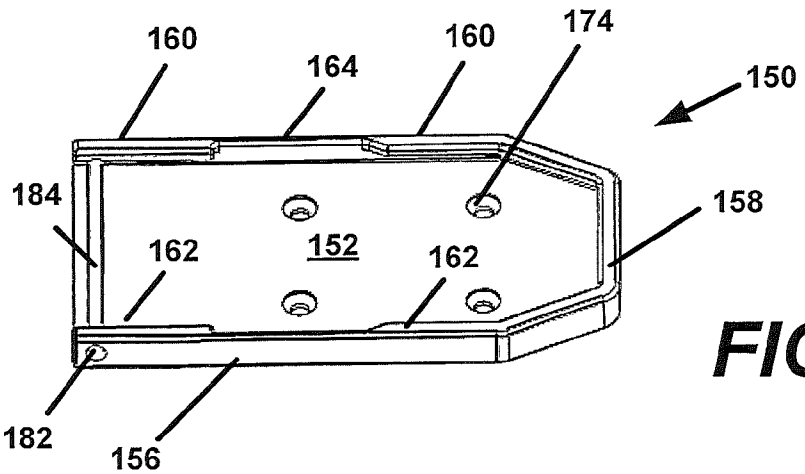
FIGS. 4B-E are a plan view, a side view, a front view and a perspective view, respectively, of the toe binding mount of the ski system of FIG. 3.
Figure 4B:
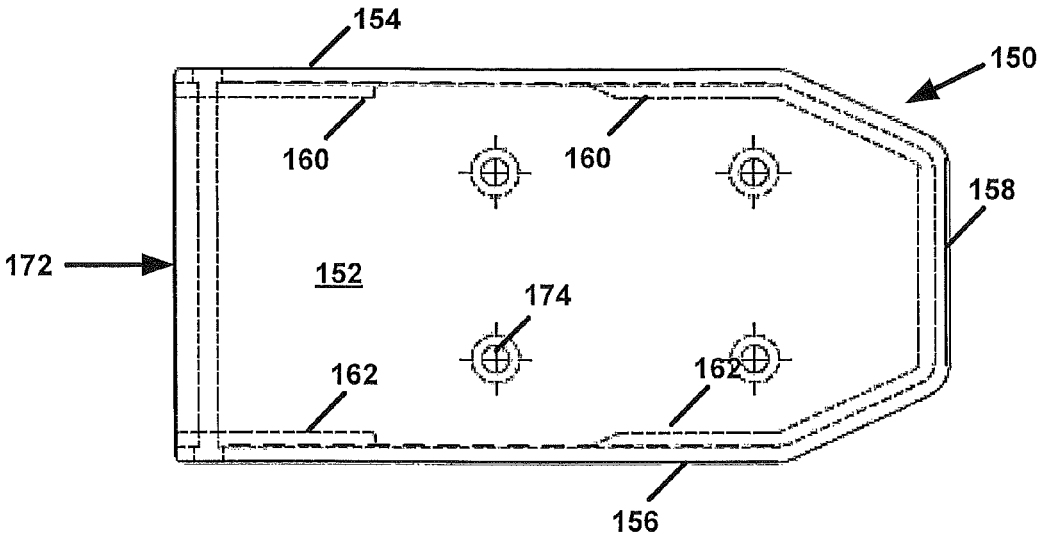
Figure 4C:
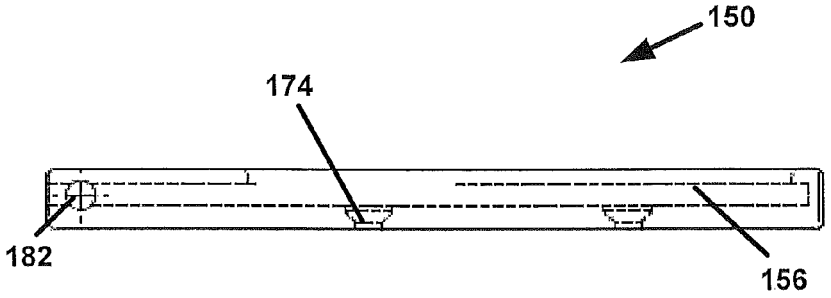
Figure 4D:
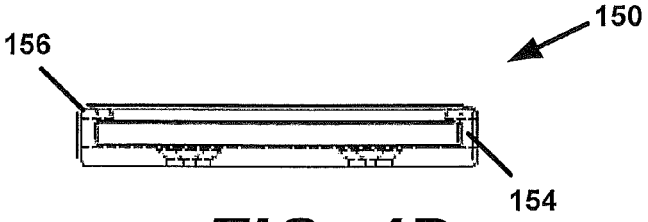
Figure 5:
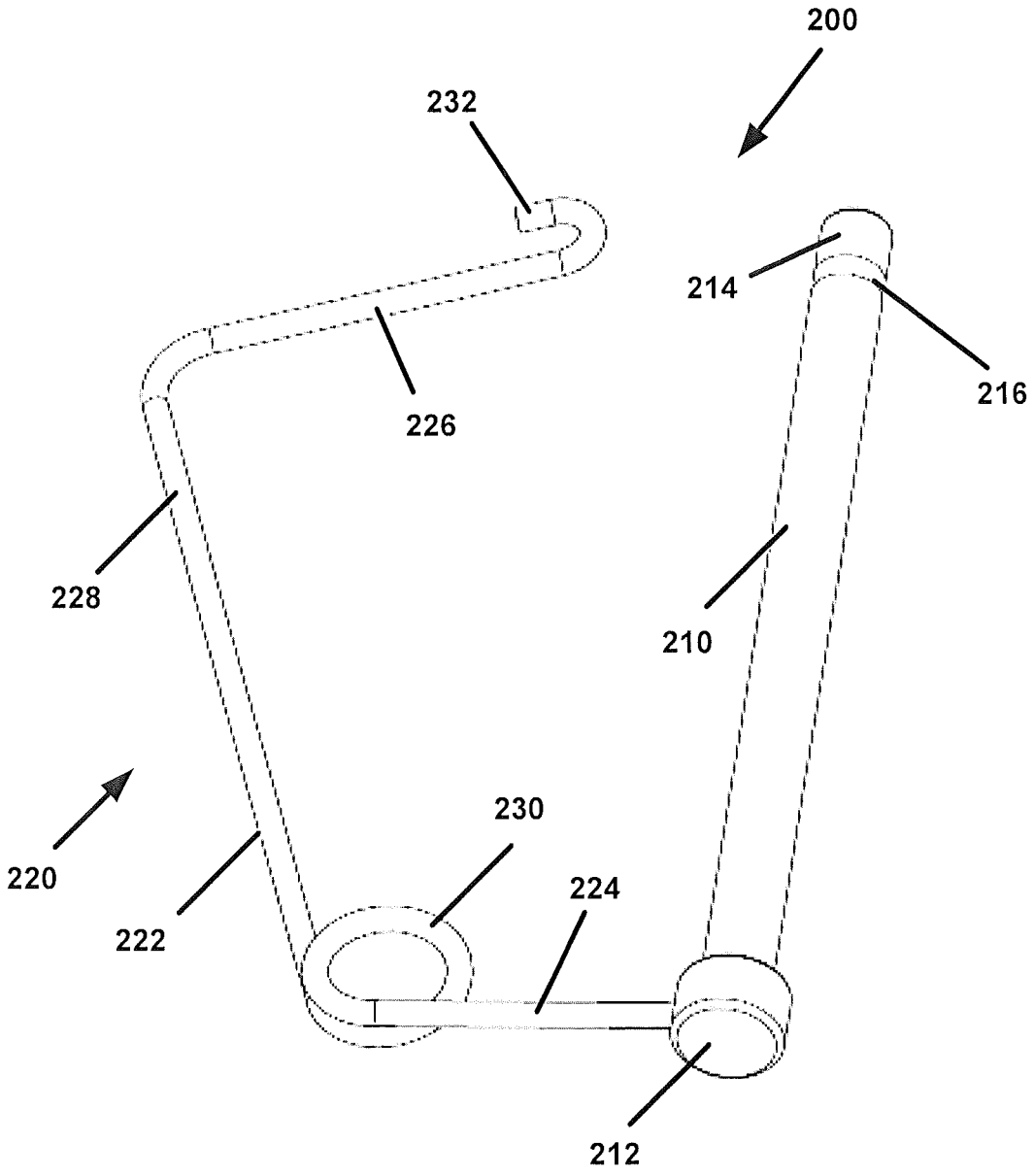
FIG. 5 is a perspective view of a quick-release locking mechanism that may be used in conjunction with the toe binding mount of FIGS. 4A-4E.
Figure 7C:
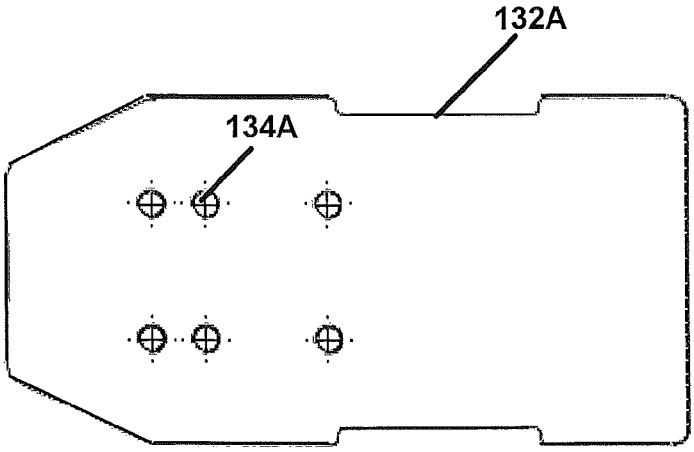
FIGS. 7C-7D are a plan view and a side view, respectively, of the support plate illustrated in FIG. 6B.
Figure 7D:
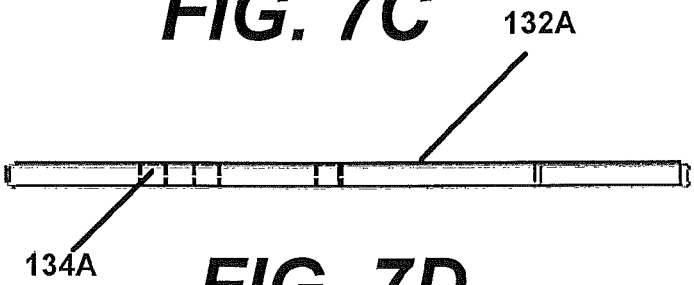
Figure 7A:
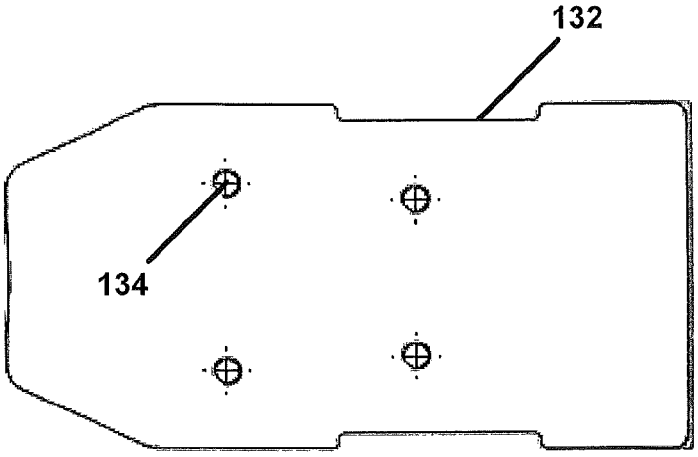
FIGS. 7A-7B are a plan view and a side view, respectively, of the support plate illustrated in FIG. 6A.
Figure 7B:
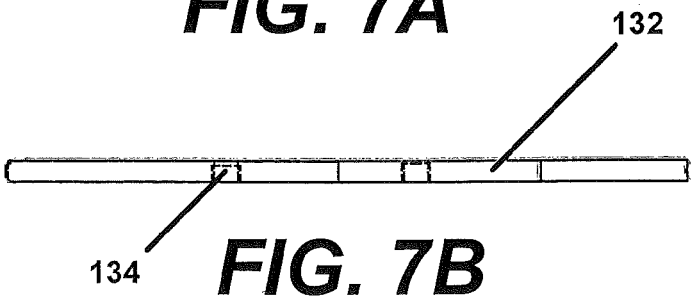
Figure 8A:
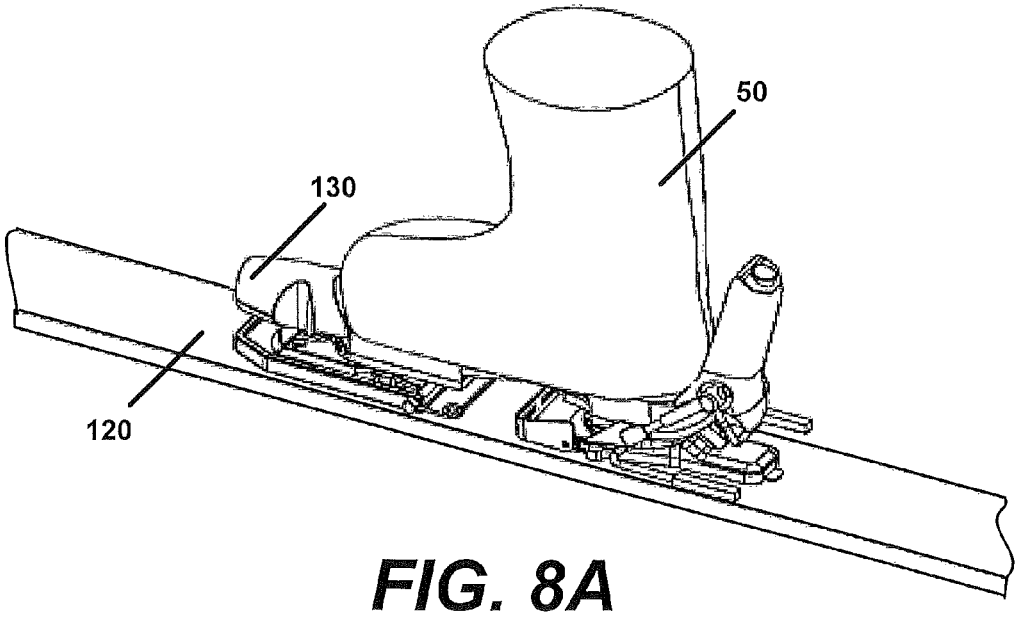
FIGS. 8A-8I are perspective views of the ski system of FIG. 3 that illustrate how a first toe binding thereof may be quickly and easily replaced with a second toe binding.
Figure 8B:
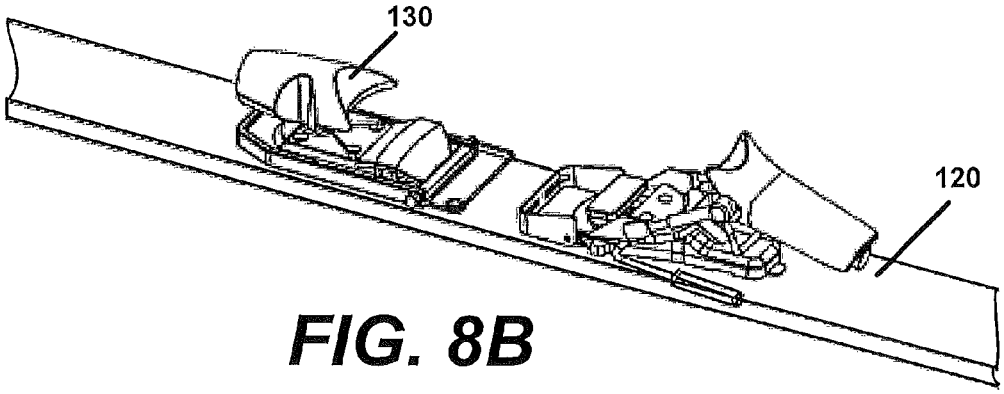
Figure 8C:
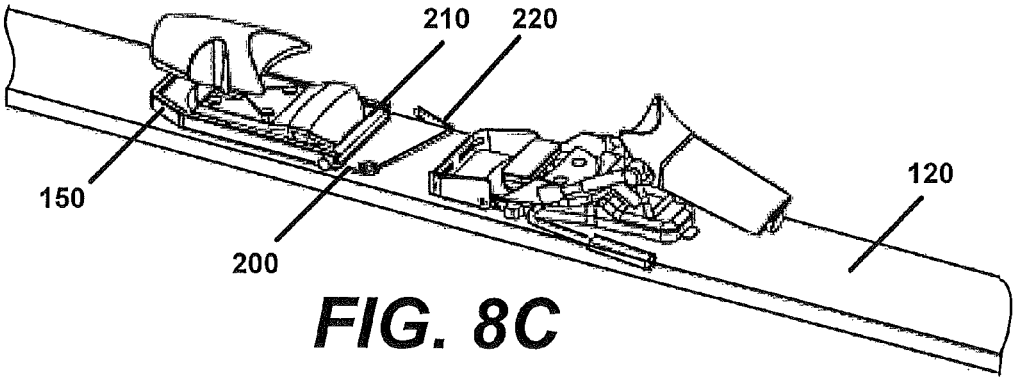
Figure 8D:
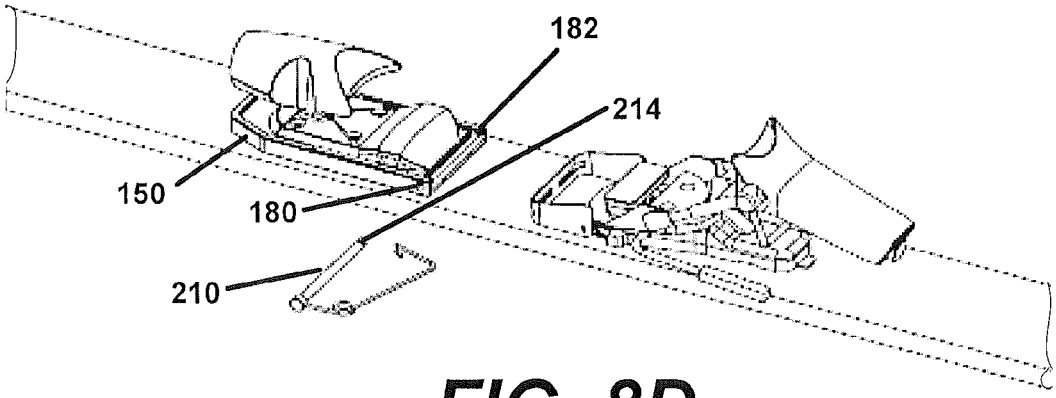
Figure 8E:
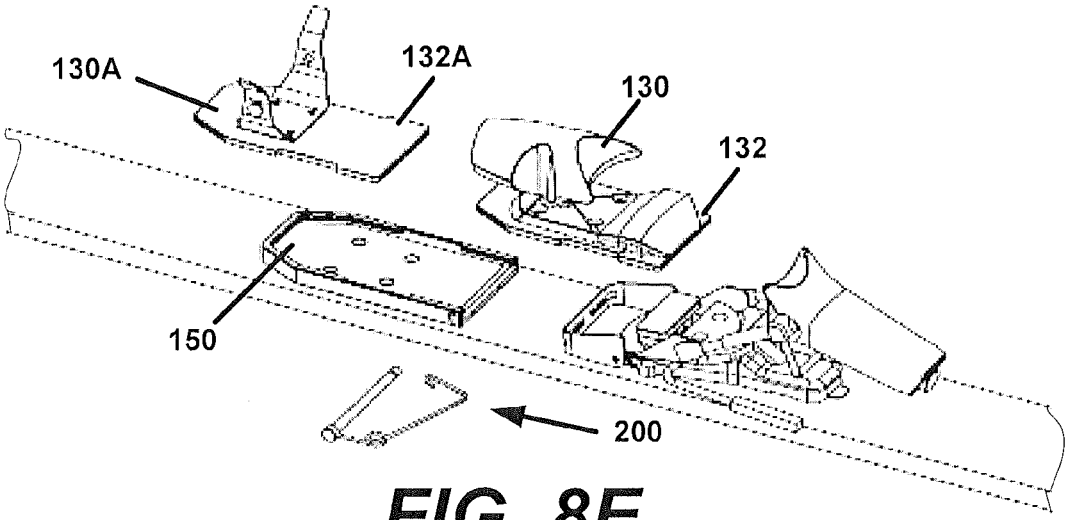
Figure 8F:
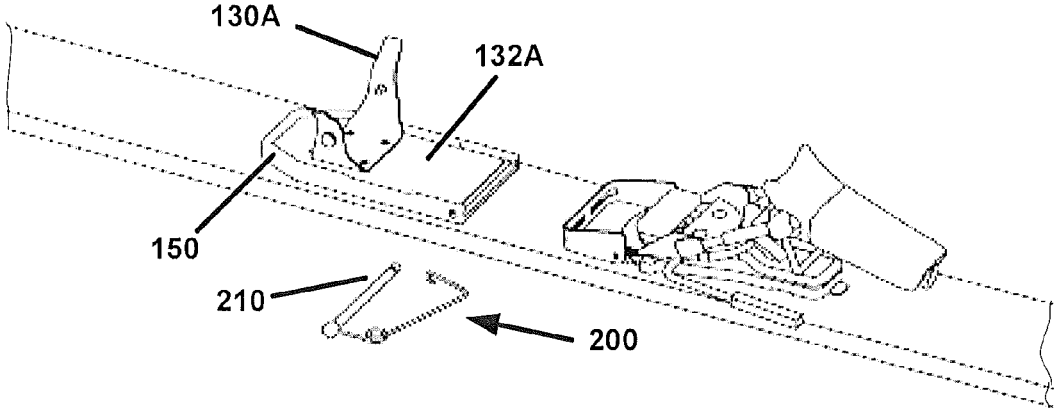
Figure 8G:
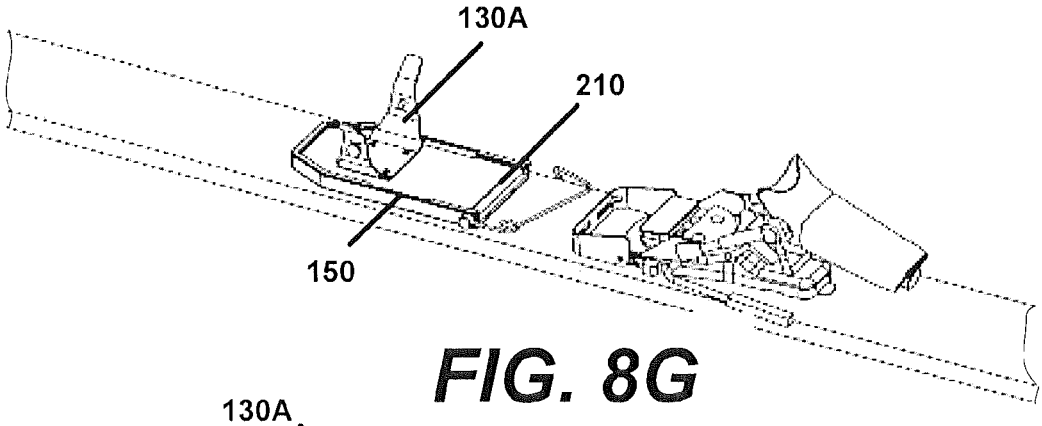
Figure 8H:
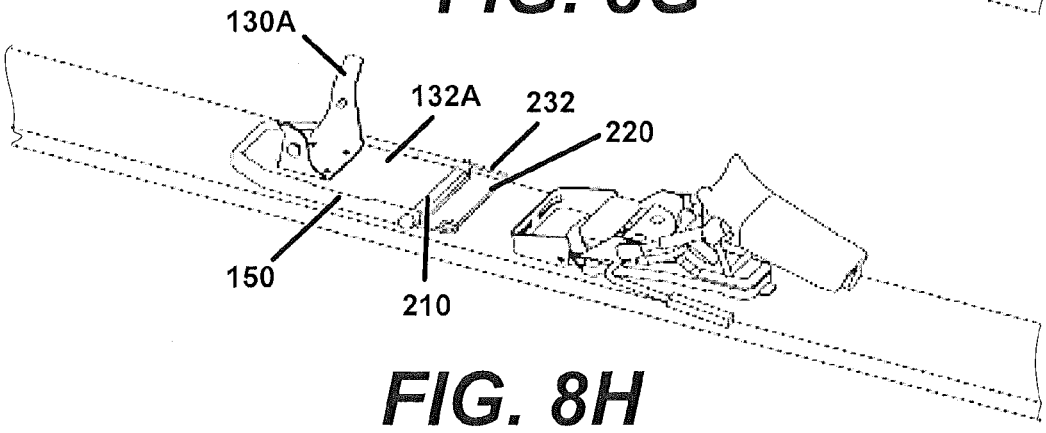
Figure 8I:
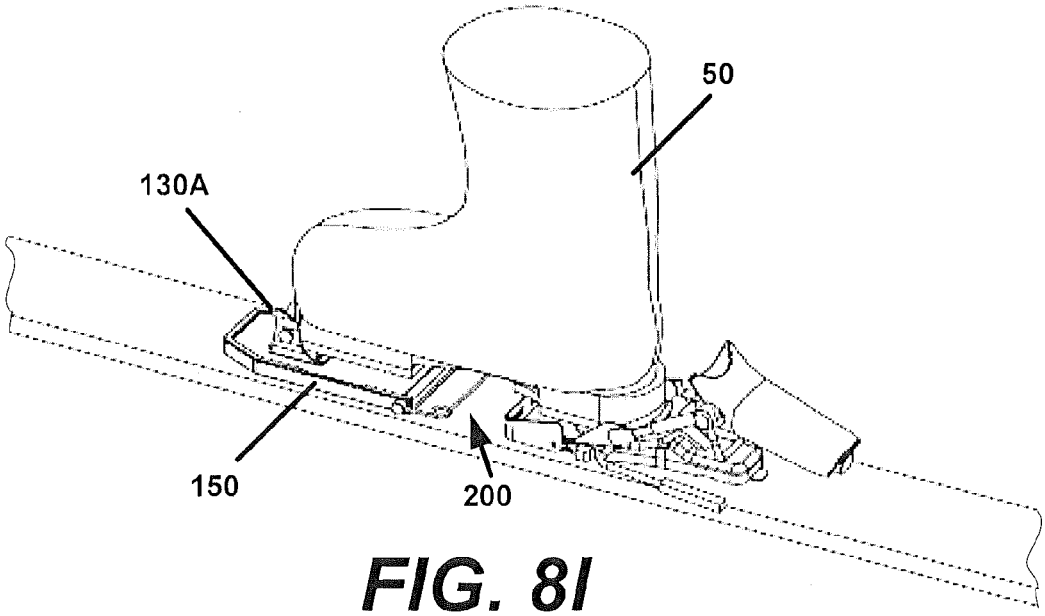
Figure 9:
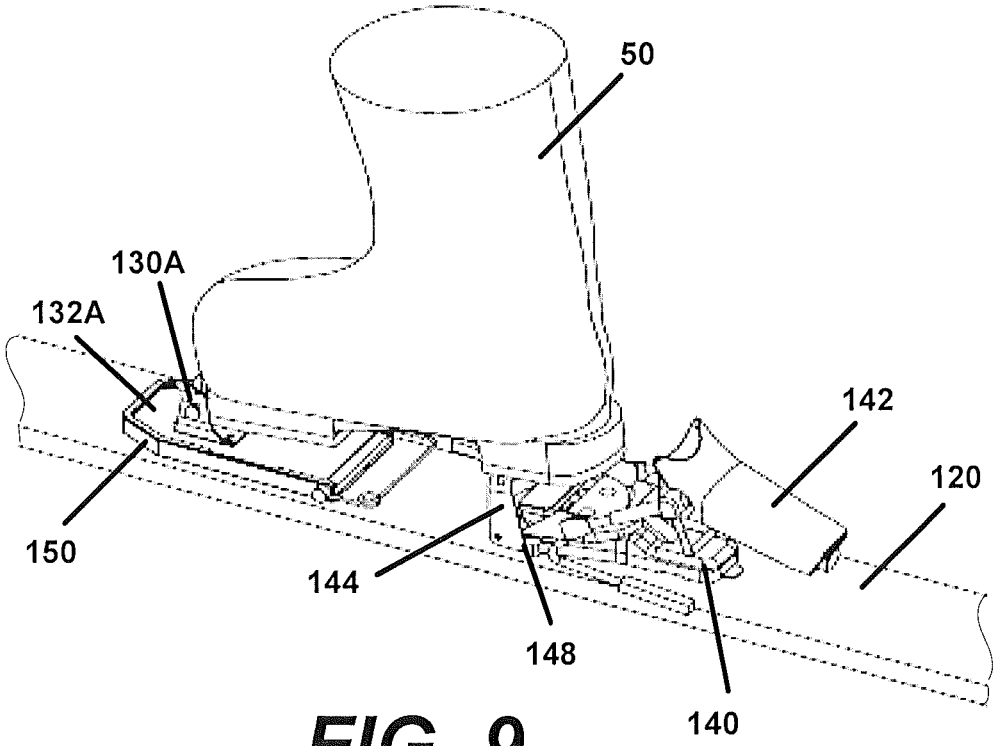
FIG. 9 is a perspective view illustrating the ski system of FIG. 3 with a different toe binding mounted in the toe binding mount thereof.

FIGS. 3-9 illustrate a ski system 100 according to first embodiments of the present invention. In particular, FIG. 3 is a side, perspective view of the ski system 100. FIG. 4A is a perspective view of a toe binding mount of the ski system of FIG. 3 that illustrates how two different binding support plates may be slidably received within the toe binding mount. FIGS. 4B-E are a plan view, a side view, a front view and a perspective view, respectively, of a toe binding mount 150 of the ski system 100. FIG. 5 is a perspective view of a quick-release locking mechanism 200 that is used in conjunction with the toe binding mount 150 of FIGS. 4A-4E. FIGS. 6A and 6B are perspective views illustrating two different toe bindings that are mounted on respective support plates for use with the toe binding mount 150 and quick-release locking mechanism 200 of FIGS. 4A-4E and 5. FIGS. 7A-7B are a plan view and a side view, respectively, of the support plate illustrated in FIG. 6A, and FIGS. 7C-7D are a plan view and a side view, respectively, of the support plate illustrated in FIG. 6B. FIGS. 8A-8I are perspective views of the ski system 100 that illustrate how a first toe binding thereof may be quickly and easily replaced with a second toe binding. Finally, FIG. 9 is a perspective view that illustrates the ski system 100 with the second toe binding mounted in the toe binding mount 150.

As shown in FIG. 3, the ski system 100 comprises a ski 120 that has a toe binding 130 and a heel binding 140 mounted thereon. The toe binding 130 is mounted forward of the heel binding 140, with both the toe binding 130 and the heel binding 140 mounted on an upper surface 122 of the ski 120. The heel binding 140 includes a locking mechanism 142 that may be used to tightly lock a ski boot 50 in place between the toe binding 130 and the heel binding 140. The ski system 100 further comprises a toe binding mount 150 that is positioned on the upper surface 122 of ski 120 forward of the heel binding 140. A quick-release locking mechanism 200 is provided that locks the toe binding 130 within the toe binding mount 150. The quick-release locking mechanism 200 may be quickly and easily unlocked by hand to allow the toe binding 130 to be removed from the toe binding mount 150 and replaced with a different toe binding, which can then be locked into place using the quick-release locking mechanism 200.

FIGS. 4A-4E illustrate the exemplary toe binding mount 150. As shown in FIGS. 4A-4E, the toe binding mount 150 may comprise, for example, a machined or molded structure that includes a base plate 152, opposed sidewalls 154 and 156 that extend upwardly from opposite sides of the base plate 152, and a front wall 158 that extends upwardly from a front portion of the base plate 152. Lips 160, 162 extend inwardly from top portions of sidewalls 154, 156, respectively. One or more gaps 164 may be provided in the lips 160, 162. Each sidewall 154, 156, in conjunction with a respective one of the lips 160, 162, forms a respective groove 166, 168. The grooves 166, 168 form a channel 172 that may receive a binding support plate, as will be discussed below. A plurality of apertures 174 are provided in the base plate 152. The apertures 174 may be aligned with corresponding threaded apertures (not shown) in the ski 120. The apertures 174 may be countersunk. Flat-headed screws may be inserted through the apertures 174 and threaded into the threaded apertures in the ski 120 to mount the toe binding mount 150 to the upper surface 122 of the ski 120.

While not shown in the drawings, in some embodiments, the base plate 152 may include a plurality of longitudinal grooves in a top surface thereof. These grooves may be formed by, for example, machining the base plate 152 to remove material to form the grooves. The provision of the grooves may decrease the weight of the base plate 152 without compromising the structural integrity of the base plate 152. Apertures 180 and 182 are formed in the sidewalls 154 and 156, respectively near the rear ends of the sidewalls 154, 156. The apertures 180, 182 may be aligned in the transverse direction of the ski 120. A transverse groove 184 may be provided in the base plate 152 and may be aligned with the apertures 180 and 182.

Figure 6A:
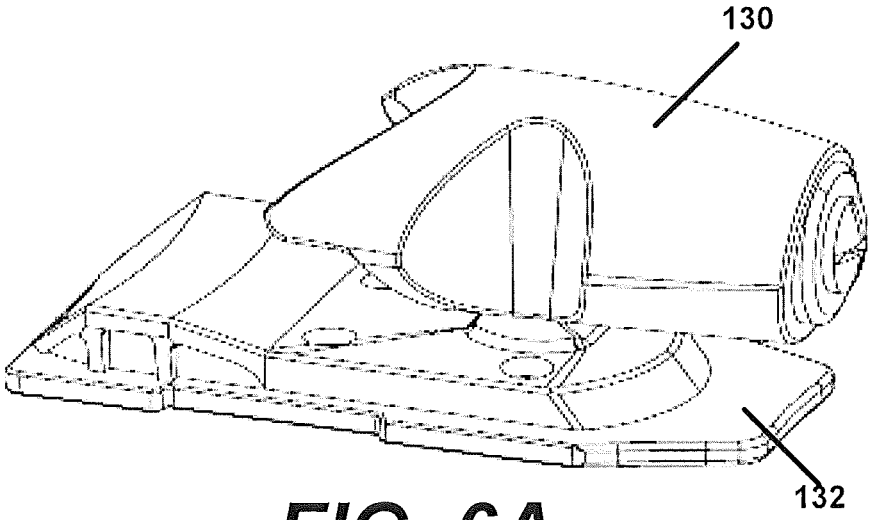
FIGS. 6A and 6B are perspective views illustrating two different toe bindings that are mounted on respective support plates for use with the toe binding mount and quick-release locking mechanism of FIGS. 4A-4E and 5.
Figure 6B:
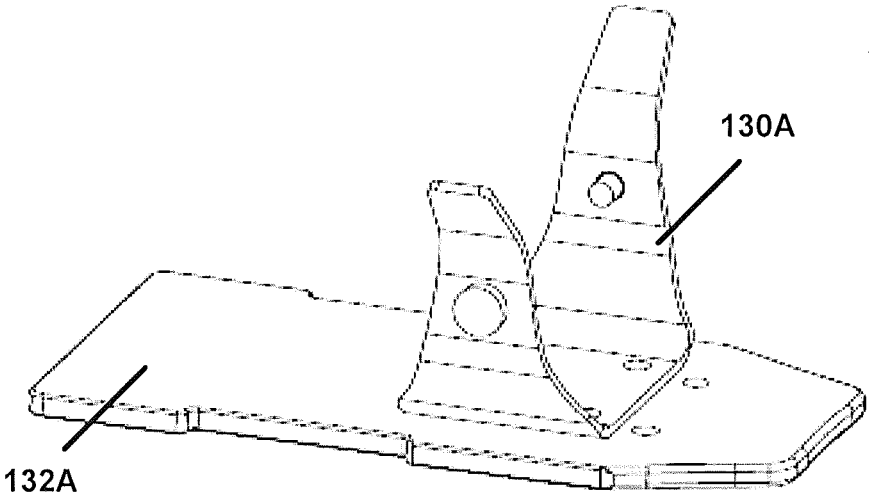

As shown in FIG. 4A, the toe binding mount 150 operates in conjunction with binding support plates 132, 132A. As shown in FIGS. 6A and 6B, the first toe binding 130 may be mounted on the support plate 132, and a second toe binding 130A may be mounted on the support plate 132A. One or the other of support plates 132, 132A may be slidably received within the toe binding mount 150, as will be discussed in more detail herein. In some embodiments, triangular (or other shaped) sections may be removed from the front side edges of the support plates 132, 132A to make it easier to slide the support plates 132, 132A into the toe binding mount 150. The side and/or front edges of the support plates 132, 132A may also be chamfered.

FIG. 5 illustrates an exemplary embodiment of a quick-release locking mechanism 200 that may be used in conjunction with the toe binding mount 150 of FIGS. 4A-4E. The quick-release locking mechanism 200 comprises a pin 210 and a latch piece 220. The pin 210 includes a base 212 and a distal end 214. The base 212 may have an enlarged longitudinal cross-section as compared to the remainder of the pin 210. A notch or groove 216 is provided at or near the distal end 214 of pin 210. The latch piece 220 comprises a stiff wire 222 that is bent to have first and second generally longitudinal segments 224, 226 and a generally transverse segment 228. One end of the first longitudinal segment 224 is received within an aperture in the base 212 of pin 210 and is held firmly in place by any conventional means such as soldering, a threaded connection, press-fitting, etc. A spring 230 is formed by looping the wire 222 at the junction between the first longitudinal segment 224 and the transverse segment 228. The distal end of the second longitudinal segment 226 is bent to form a hook 232. The wire 222 is thus spring-mounted in a cantilevered fashion to extend from the base 212 of pin 210. While FIG. 5 illustrates the latch piece 220 in its resting position, it will be appreciated that the transverse segment 228 may be pushed forwardly into an activated position where the hook 232 is mounted within the notch or groove 216 on the distal end 214 of pin 210. In the activated position the spring bias on the wire 222 tends to lock the hook 232 within the groove or notch 216.

The quick-release locking mechanism 200 may be used to lock one of the support plates (e.g., support plate 132, which will have the toe binding 130 mounted thereon) in the toe binding mount 150 as follows. After the support plate 132 or 132A is slidably received within the channel 172 of toe binding mount 150, the distal end 214 of lock pin 210 may be inserted through aperture 180 in sidewall 154, along the transverse groove 184, and through the aperture 182 in sidewall 156. Thereafter, a user may bend the latch piece 220 forwardly about its cantilevered connection with the base 212 until the hook 232 on the distal end of the longitudinal segment 226 may be looped around the distal end 214 of pin 210. The hook 232 may be received within the notch or groove 216 provided adjacent the distal end 214 of pin 210, and the spring action of the latch piece 220 may hold the hook 232 in place. Thus, the latch piece 220 may be used to hold the lock pin 210 in place in the transverse groove 184. Once locked in place, the lock pin 210 acts to prevent rearward movement of the support plate 132 for the toe binding 130, thereby locking the toe binding 130 in place within the toe binding mount 150. The latch piece 220 holds the pin 210 in place within the apertures 180, 182 so that the toe binding 130 may be firmly locked in place within the toe binding mount 150.

While FIG. 5 illustrates one exemplary quick-release locking mechanism 200, it will be appreciated that numerous other mechanisms could be used. For example, with respect to the toe binding mount 150 of FIGS. 4A-4E, any structure that locks the support plates 132 or 132A in place and prevents these support plates 132, 132A from sliding out of the toe binding mount 150 that also can be quickly and easily released by hand could be used.

FIGS. 6A and 6B are perspective views illustrating the toe binding 130 and a second toe binding 130A that may be used in the ski system 100. As shown in FIG. 6A, the first toe binding 130 may be, for example, an ISO DIN alpine ski binding that is designed for descending mountains. The toe binding 130 is mounted on the support plate 132. As shown in FIG. 6B, the second toe binding 130A may be, for example, a conventional Dynafit touring toe binding that is designed for ascending mountains. The toe binding 130A is mounted on the support plate 132A. It will be appreciated that the size and/or the shape of the support plates 132, 132A may be varied from what is shown in FIGS. 6A and 6B.

FIGS. 7A-7B are a plan view and a side view, respectively, of the support plate 132 that is illustrated in FIG. 6A. As shown in FIGS. 7A and 7B, the support plate 132 includes four apertures 134. Four screws are inserted through respective apertures in the toe binding 130 and then threaded into these apertures 134 in order to mount the toe binding 130 onto the top surface of the support plate 132.

FIGS. 7C-7D are a plan view and a side view, respectively, of the support plate 132A that is illustrated in FIG. 6B. As shown in FIGS. 7C and 7D, the support plate 132A also includes six apertures 134A. The forward-most two apertures 134A are not used (see FIG. 6B). Four screws are inserted through the remaining four apertures in the toe binding 130A and then threaded into these apertures 134A in order to mount the toe binding 130A onto the top surface of the support plate 132A.

Referring again to FIGS. 7A-7D, it can be seen that while the support plates 132 and 132A may be identical in size, the apertures 134 and 134A may be arranged in different patterns on the support plates 132 and 132A, respectively, in order to mount the toe binding 130A farther forward on the ski 120 as compared to the toe binding 130. In particular, the toe binding 130 is positioned further rearwardly than the toe binding 130A (see FIGS. 6A-6B) so that when the toe binding 130 is used, the heel of the ski boot 50 will be locked in the heel binding 140. In contrast, when the toe binding 130A is used, the heel of the ski boot 50 is not locked in the heel binding 140.

FIGS. 8A-8I are perspective views of the ski system 100 that illustrate how the toe binding mount 150 and the quick-release locking mechanism 200 allow for a user to quickly and easily replace the first toe binding 130 with the second toe binding 130A.

FIG. 8A illustrates the ski system 100 with the toe binding 130 (mounted on support plate 132) being used to hold a ski boot 50 in place on the ski 20. As shown in FIG. 8B, the toe binding replacement operation may begin with a user removing the boot 50 from the ski 120. Next, as shown in FIG. 8C, the user may unlatch the latch piece 220 from the lock pin 210. As shown in FIG. 8D, once the latch piece 220 is unlatched, the distal end 214 of the lock pin 210 may be pulled through the apertures 180 and 182 so that the quick-release locking mechanism 200 is removed from the toe binding mount 150.

Next, as shown in FIG. 8E, the support plate 132 with the toe binding 130 mounted thereon may be slid rearwardly out of the toe binding mount 150. Once the toe binding 130 has been removed, the support plate 132 with the toe binding 130A mounted thereon may be slid into the toe binding mount 150, as is shown in FIG. 8F. As shown in FIG. 8G, the locking pin 210 of the quick-release locking mechanism 200 may then be inserted into position in the rear of the toe binding mount 150. Next, as shown in FIG. 8H, the hook 232 on latch piece 220 may be inserted into the groove or notch 216 on pin 210 to finish locking the support plate 132A with the toe binding 130A mounted thereon in place. Finally, the ski boot 50 may be mounted in the toe binding 130A, as is shown in FIG. 8I. Notably, all of the above steps may be completed by hand without the use of any tools.

FIG. 9 illustrates the ski system 100 with the support plate 132A and toe binding 130A mounted in the toe binding mount 150. As noted above, the toe binding 130A is mounted farther forward on its support plate 132A as compared to manner in which the toe binding 130 is mounted on its support plate 132. This forward offset positions the ski boot 50 more forwardly when the toe binding 130A is mounted on the ski 120 so that the ski boot 50 is clear of the locking mechanism 142 on the heel binding 140. The heel binding 140 further includes a climbing bail 144 that the heel of the ski boot 50 rests on during uphill ascents. This climbing bail 144 can increase comfort when a skier is ascending steep slopes.

As is also shown in FIG. 9, in some embodiments, a thin riser plate 148 may be provided between the heel binding 140 and the ski 120. The riser plate 148 may comprise a thin, flat plate that has a plurality of apertures (not visible in the drawings) drilled or otherwise formed therethrough. These apertures may be formed in a pattern such that the screws that are used to mount the heel binding 140 to the ski 120 will extend through the respective apertures. The riser plate 148 may be formed, for example, of nylon or another plastic material that is not easily compressible. The riser plate 148 may, for example, have a thickness that is similar to the thickness of the base plate 152 or of the combination of the thicknesses of the base plate 152 and the support plate 132 or 132A. In some embodiments, the riser plate 148 may raise the heel binding an amount above the top surface 122 of the ski 120 that is similar to the amount that the toe binding mount 150 raises the toe binding 130 or 130A above the top surface 122 of the ski 120. The climbing bail 144 may be mounted on the riser plate 148 in order to avoid having to drill any additional holes in the ski 120.

Figure 10:
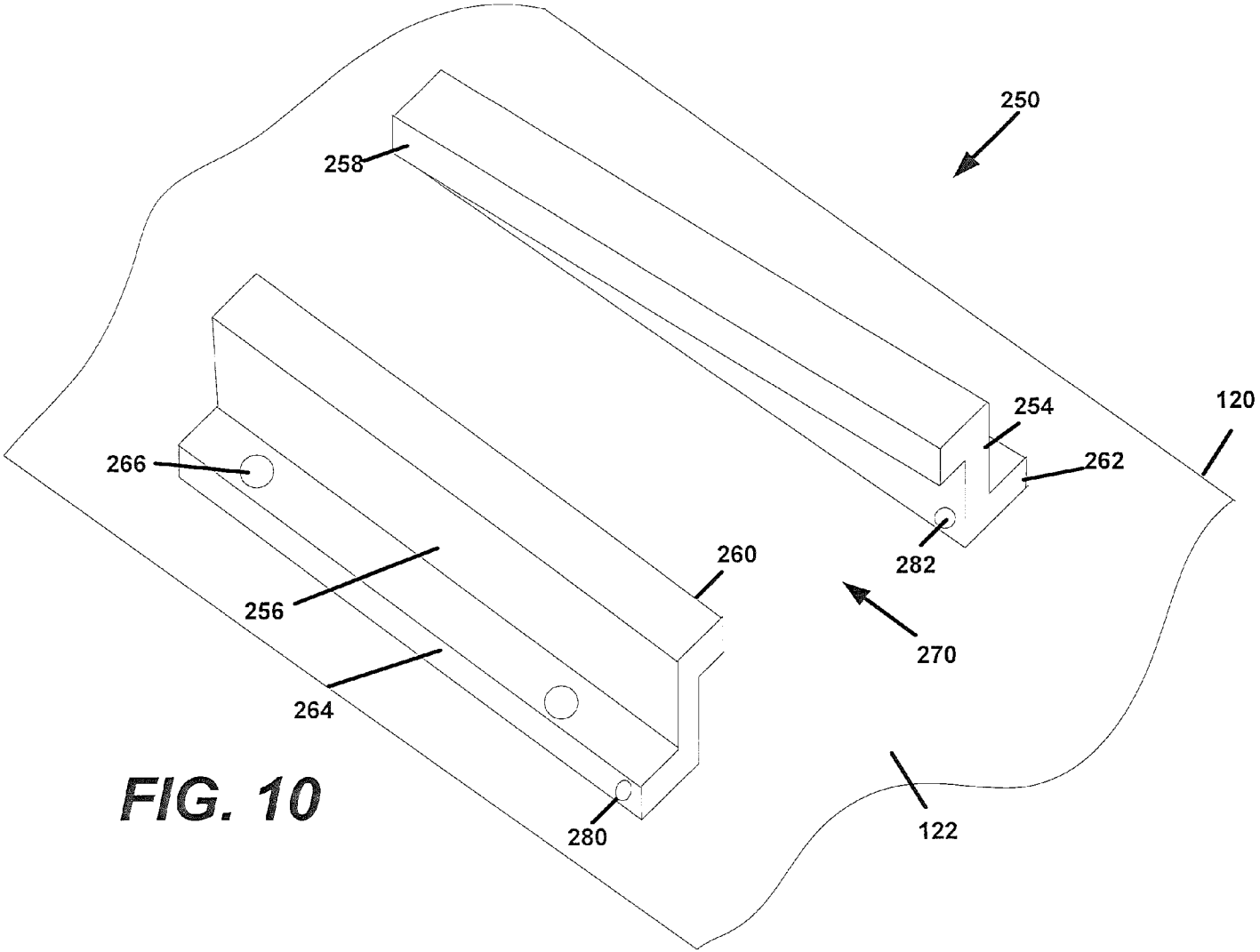
FIG. 10 is a perspective view of a toe binding mount according to further embodiments of the present invention.

FIG. 10 is a schematic perspective view of a toe binding mount 250 according to further embodiments of the present invention. The toe bindings 130, 130A are mounted on support plates (not shown) that are designed to snugly fit within the toe binding mount 250. The toe binding mount 250 may be used, for example, in place of the toe binding mount 150 in the ski system 100 illustrated in FIGS. 3-9. The support plates that are used with the toe binding mount 250 may be identical to the binding support plates 132, 132A that are described above, except that they may be shaped to have angled sides that match the angles of sidewalls 254, 256.

As shown in FIG. 10, the toe binding mount 250 is similar to the toe binding mount 150, except that the toe binding mount 250 includes first and second walls 254, 256 that are mounted on the upper surface 122 of ski 120 to be angled with respect to each other. Wall 254 includes an inwardly extending lip 258 and wall 256 includes an inwardly extending lip 260. In the depicted embodiment, the toe binding mount 250 does not include a front wall, as the narrowed distance between the walls 254, 256 toward the front of the ski 120 prevents the support plates from sliding forward past their desired mounting locations within toe binding mount 250. However, it will be appreciated that a front wall could be provided in some embodiments. The depicted toe binding mount 250 does not include a base plate such as the base plate 152 of toe binding mount 150. Consequently, the support plates (not shown) will rest directly on the top surface 122 of ski 120 when one of the support plates (not shown) that includes the respective toe bindings 130, 130A mounted thereon are slidably inserted into the toe binding mount 250. It will be appreciated, however, that in further embodiments, a base plate similar to base plate 152 could be provided with the toe binding mount 250.

The walls 254, 256 may be formed integral with the ski 120 or, alternatively, the walls 254, 256 may be mounted on the ski 120 via, for example, screws or other conventional mounting structures or techniques. In the depicted embodiment, lips 262, 264 extend outwardly from the bottom surface of walls 254, 256, respectively. Each lip 262, 264 includes a pair of apertures 266 that may receive one of a plurality of screws 268 that are used to mount the walls 254, 256 to the upper surface 122 of ski 120. The walls 254, 256 define a channel 270. Apertures 280, 282 are provided near the rear edge of walls 254, 256.

In operation, one of the support plates (with its respective toe binding 130, 130A mounted thereto) is slidably inserted into the channel 270 from the rear of toe binding mount 250. Forward movement of the support plate is prevented by the narrowing of the channel 270, which automatically positions the support plate at a desired mounting location. Once the support plate is moved to this desired mounting location, it will have moved forwardly past the apertures 280, 282. The lock pin 210 of quick-release locking mechanism 200 may then be inserted through the apertures 280, 282 in the same manner described above with respect to toe binding mount 150 in order to lock the support plate 232, 232A within the toe binding mount 250. Otherwise, the toe binding mount 250 may operate in an essentially identical matter to the toe binding mount 150 described above, and hence further description thereof will be omitted herein.

Figure 11A:
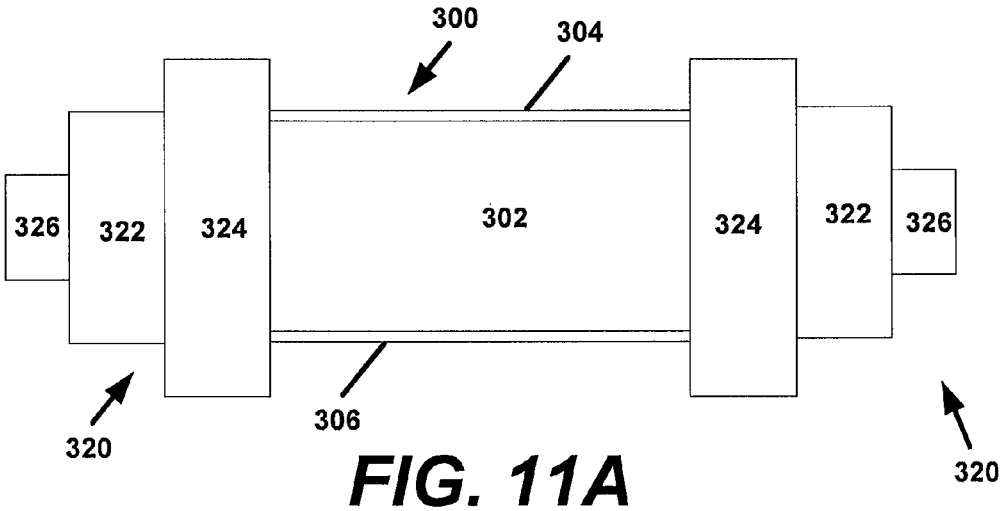
FIGS. 11A and 11B are schematic plan views of a toe binding mount according to still further embodiments of the present invention.
Figure 11B:
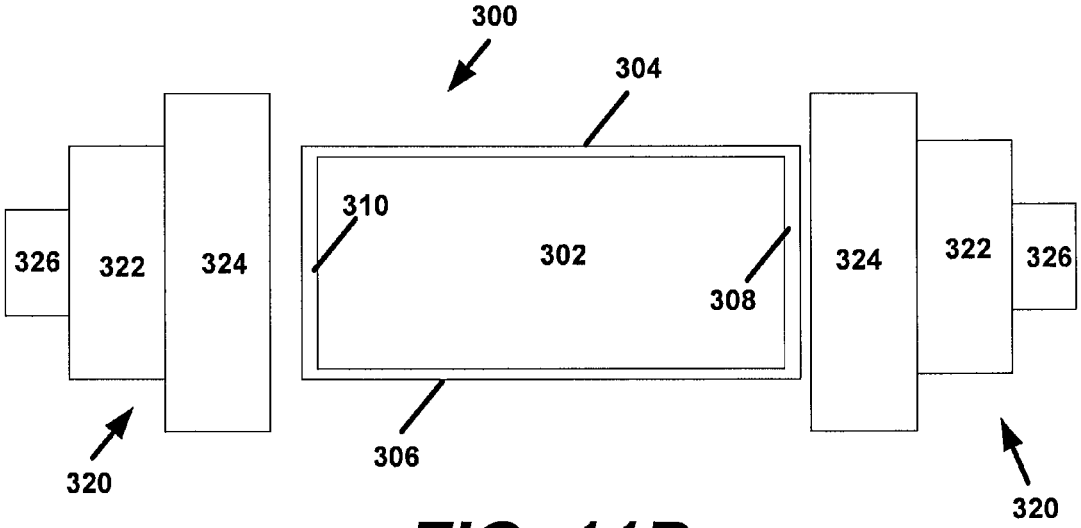

FIGS. 11A and 11B are schematic plan views of a toe binding mount 300 according to still further embodiments of the present invention that uses a plurality of spring clips to releasably lock the toe binding 130 or the toe binding 130A within the toe binding mount 300.

As shown in FIGS. 11A-11B, the toe binding mount 300 comprises a base plate 302 that has upwardly extending sidewalls 304, 306 and front and rear walls 308, 310, respectively. The toe binding mount 300 further includes first and second spring clips 320 that are positioned at the respective front and rear ends of the toe binding mount 300. The spring clips 320 are shown schematically in FIGS. 11A and 11B, as any appropriate spring-biased clip mechanism may be used. Each spring clip 320 includes a body 322, a restraining jaw 324 and a pivoting release lever 326. The jaw 324 is pivotally movable about the body 322 to move from a first restraining position (see FIG. 11A) in which the jaws 324 hold the support plate 132 on which the toe binding 130 is mounted within a support plate cavity defined by walls 304, 306, 308 and 310 to a second released position (see FIG. 11B) in which the jaws 324 no longer hold the support plate 132 within the support plate cavity defined by walls 304, 306, 308 and 310. The jaw 324 is moved from the released position to the restraining position by hand action of the lever 326. Likewise, a skier can move the jaw 324 from the restraining position to the released position by hand action of the lever 326.

Figure 12:
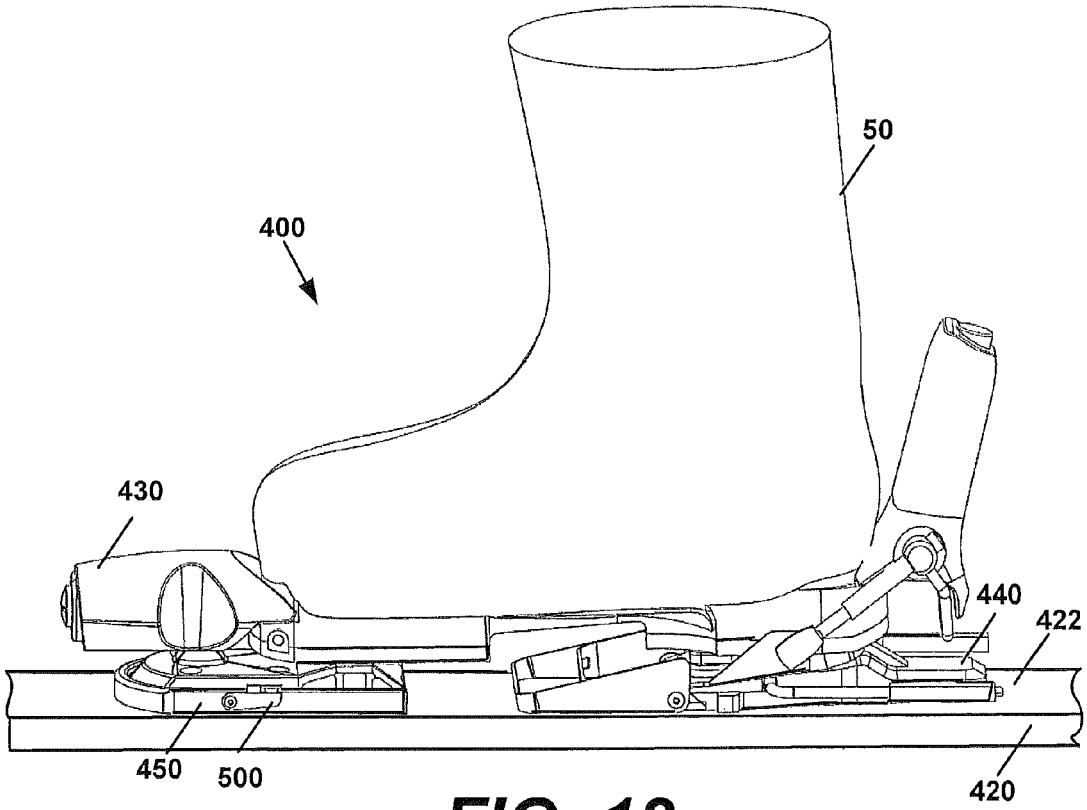
FIG. 12 is a side, perspective view of a ski system according to additional embodiments of the present invention.
Figure 13A:
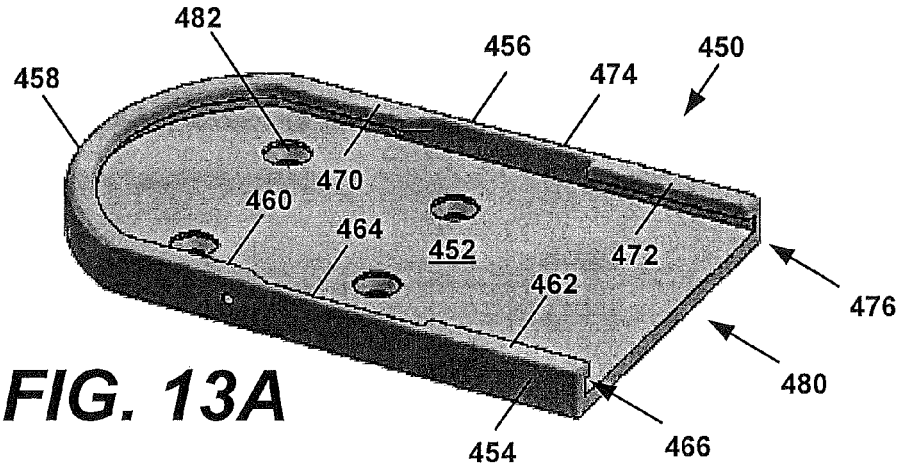
FIGS. 13A-13D are a perspective view, a plan view, a side view and a front view, respectively, of a toe binding mount and quick-release locking mechanism of the ski system of FIG. 12.
Figure 13B:
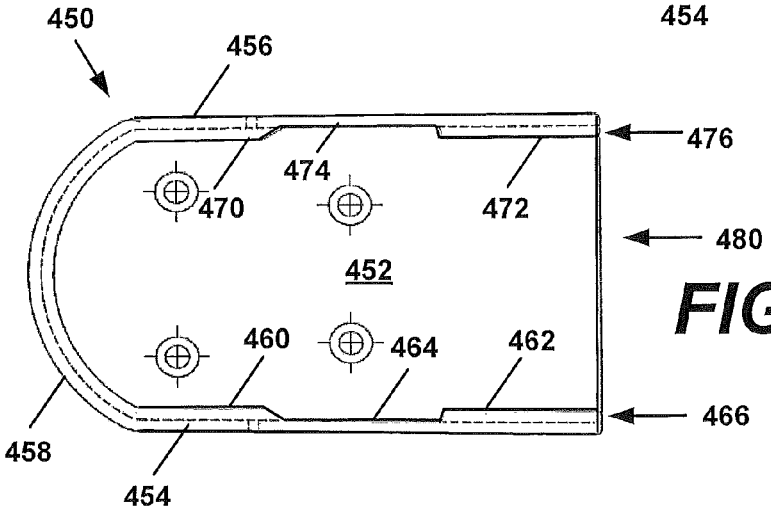
Figure 13C:
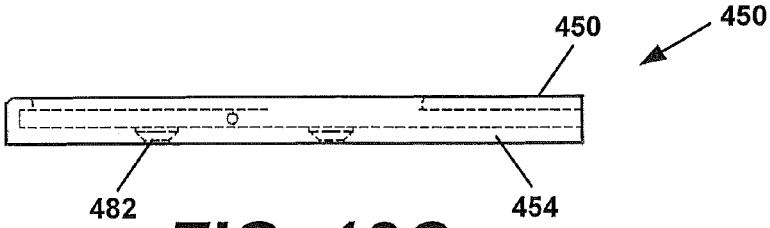
Figure 13D:
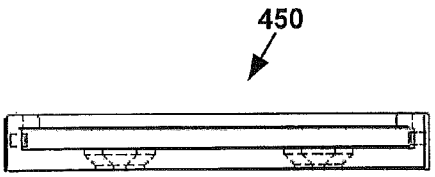
Figure 14A:
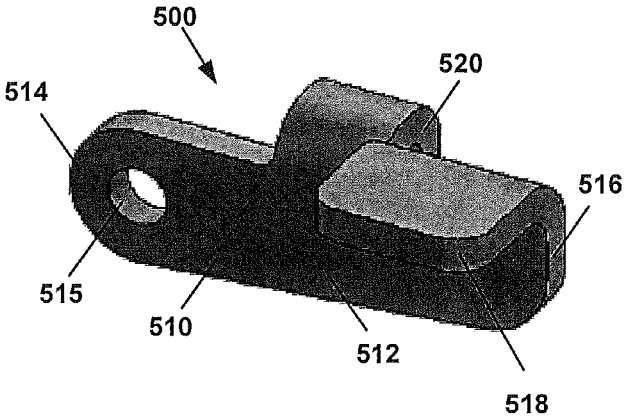
FIGS. 14A-D are a perspective view, a top view, a side view and a front view, respectively, of the quick-release locking mechanism depicted in FIGS. 13A-13D.
Figure 14B:
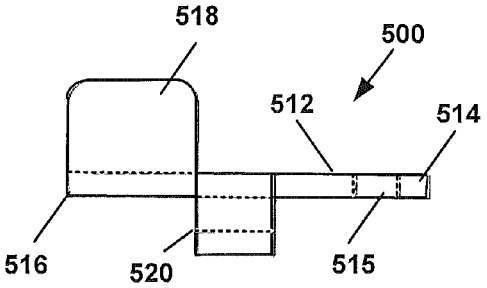
Figure 14C:
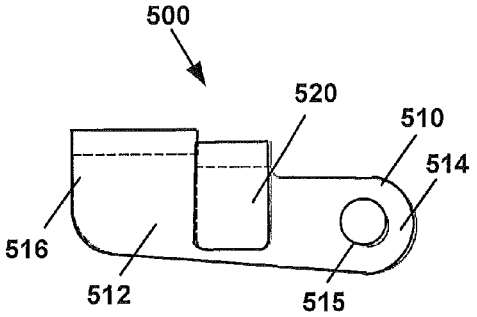
Figure 14D:
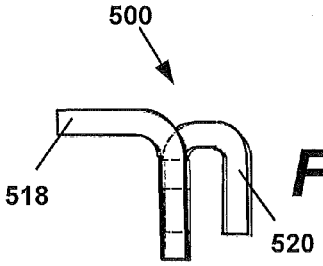
Figure 15B:
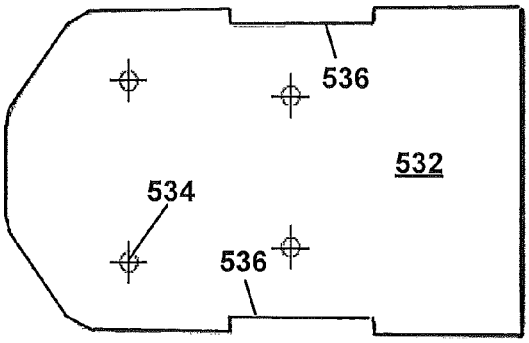
FIGS. 15A-15C are a perspective view, a plan view and a side view, respectively, of a first support plate that may be used with the toe binding mount of FIGS. 13A-13D.
Figure 15A:
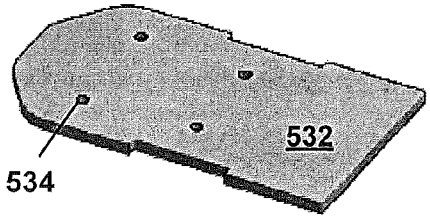
Figure 15C:
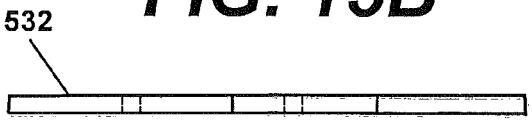
Figure 16B:
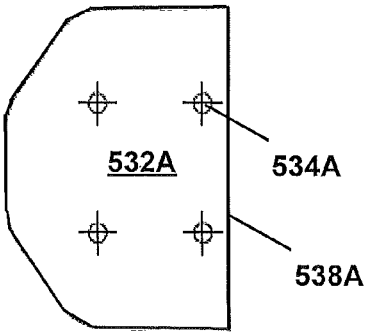
FIGS. 16A-16C are a perspective view, a plan view and a side view, respectively, of a second support plate that may be used with the toe binding mount of FIGS. 13A-13D.
Figure 16A:
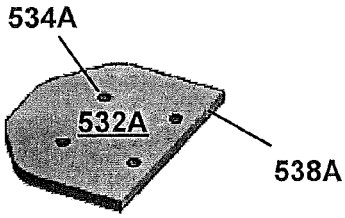
Figure 16C:
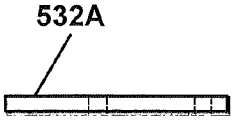
Figure 17:
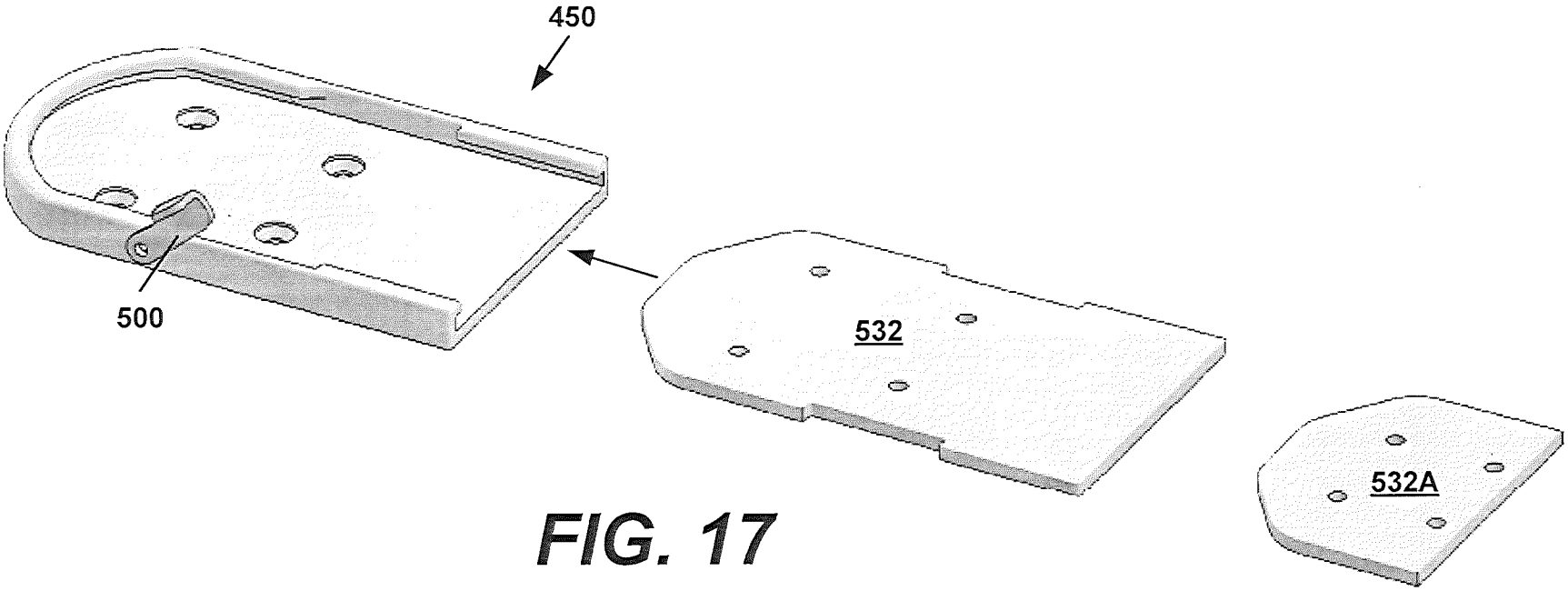
FIG. 17 is a perspective view of a toe binding mount of the ski system of FIG. 12 that illustrates how the first and second support plates of FIGS. 15A-15C and 16A-16C, respectively, may be slidably received within the toe binding mount.

FIGS. 12-18 illustrate a ski system 400 according to further embodiments of the present invention. In particular, FIG. 12 is a side, perspective view of the ski system 400. FIGS. 13A-13D are a perspective view, a plan view, a side view and a front view, respectively, of a toe binding mount and quick-release locking mechanism of the ski system 400. FIGS. 14A-D are a perspective view, a top view, a side view and a front view of the quick-release locking mechanism depicted in FIGS. 13A-13D. FIGS. 15A-15C are a perspective view, a plan view and a side view, respectively, of a first support plate that may be used with the toe binding mount of FIGS. 13A-13D. FIGS. 16A-16C are a perspective view, a plan view and a side view, respectively, of a second support plate that may be used with the toe binding mount of FIGS. 13A-13D. FIG. 17 is a perspective view of a toe binding mount of the ski system of FIG. 12 that illustrates how the first and second support plates of FIGS. 15A-15C and 16A-16C, respectively, may be slidably received within the toe binding mount. Finally, FIGS. 18A-18H are perspective views of the ski system 400 that illustrate how a first toe binding thereof may be quickly and easily replaced with a second toe binding.

As shown in FIG. 12, the ski system 400 comprises a ski 420 that has a toe binding 430 and a heel binding 440 mounted on an upper surface 422 thereof. The toe binding 430 and the heel binding 440 may be identical to the toe binding 130 and heel binding 140, respectively, that are discussed above and hence further description thereof will be omitted. The ski system 400 further comprises a toe binding mount 450 that is positioned on the upper surface 422 of ski 420. A quick-release locking mechanism 500 is provided that locks a support plate 532 (see FIGS. 15A-15C) that holds the toe binding 430 within the toe binding mount 450.

FIGS. 13A-13D better illustrate the toe binding mount 450. As shown in FIGS. 13A-13D, the toe binding mount 450 may comprise a machined or molded structure that includes a base plate 452, opposed sidewalls 454 and 456 that extend upwardly from opposite sides of the base plate 452, and a rounded front wall 458 that extends upwardly from a front portion of the base plate 452. A first lip 460 extends inwardly from a top, forward portion of the sidewall 454, and a second lip 462 extends inwardly from a rear portion of the sidewall 454. The first and second lips 460, 462 are separated by a gap 464 where no lip is provided. A third lip 470 extends inwardly from a top, forward portion of the sidewall 456, and a fourth lip 472 extends inwardly from a rear portion of the sidewall 456. The third and fourth lips 470, 472 are separated by a gap 474 where no lip is provided. The first sidewall 454, in conjunction with the first and second lips 460, 462, form a first groove 466. The second sidewall 456, in conjunction with the third and fourth lips 470, 472, form a second groove 476. The grooves 466, 476 form a channel 480 that may receive a support plate 532, 532A, as will be discussed below. A plurality of apertures 482 are provided in the base plate 452. The apertures 482 may be aligned with corresponding threaded apertures (not shown) in the ski 420. Screws may be inserted through the apertures 482 and threaded into the threaded apertures in the ski 420 to mount the toe binding mount 450 to the ski 420.

The toe binding mount 450 may operate in conjunction with a pair of support plates 532, 532A (see FIGS. 15A-15C and 16A-16C) that have respective first and second toe bindings mounted thereon. The toe bindings may be, for example, the toe bindings 130, 130A that are depicted in FIGS. 6A and 6B. One or the other of support plates 532, 532A may be slidably received within the grooves 466, 476/channel 480 of the toe binding mount 450.

FIGS. 14A-D are a perspective view, a top view, a side view and a front view, respectively, of a quick-release locking mechanism 500 that may be used in conjunction with the toe binding mount 450. The quick-release locking mechanism 500 comprises a metal clip 510 that is rotatably mounted on the sidewall 454 of the toe binding mount 450. A second quick-release locking mechanism (not shown) may optionally be mounted on the sidewall 456 of the toe binding mount 450. The metal clip 510 includes an arm 512 that has a first (base) end 514 that includes an aperture 515 and a second, distal end 516. The first end 514 of the arm 512 is mounted on an exterior surface of the sidewall 454 by a bolt, rivet or the like that is received within the aperture 515 (and also within an aperture in the sidewall 454) so as to mount the arm 512 so that it may rotate between a first, open position (see FIG. 18B) and a second, locked position (see FIG. 18A). A tab 518 is provided that extends outwardly from the distal end 516 of the arm 512. A user may grasp the tab 518 to rotate the arm 512 between its first, open position and its second, locked position. A stop 520 extends inwardly and downwardly from a central portion of the arm 512. When the arm 512 is in its first, open position (see FIG. 18B), the stop 520 is positioned above the gap 474 between lips 470 and 472, and hence will not contact any support plate 532, 532A that is received within the grooves 466, 476. In contrast, when the arm 512 is in its second, closed position (see FIG. 18A), the stop 520 is received within the gap 474 between lips 470 and 472, and extends downwardly to touch (or nearly touch) the base plate 452 so as to lock one of the support plates 532, 532A within the toe binding mount 450 in the manner described below.

FIGS. 15A-15C are a perspective view, a plan view and a side view, respectively, of a first support plate 532 that may be used with the toe binding mount 450. As shown in FIGS. 15A-15C, the support plate 532 includes four apertures 534. Four screws are inserted through respective apertures in the toe binding 130 and then threaded into these apertures 534 in order to mount the toe binding 130 onto the top surface of the support plate 532. The support plate 532 also includes two recessed regions 536 in its respective sidewalls.

FIGS. 16A-16C are a perspective view, a plan view and a side view, respectively, of a second support plate 532A that may also be used with the toe binding mount 450. As shown in FIGS. 16A-16C, the support plate 532A includes four apertures 534A. Four screws are inserted through respective apertures in the toe binding 130 and then threaded into these apertures 534A in order to mount the toe binding 130 onto the top surface of the support plate 532A. Notably, the support plate 532A is less than half the length of support plate 532. This reduces the weight of the support plate 532A. A shorter support plate 532A may be used because the toe binding 130A is significantly smaller than the toe binding 130. Given the shortened length of the support plate 532A, it may either be slid backwards underneath all four lips 460, 462, 470, 472 to remove the support plate 532A from the toe binding mount 450 or, alternatively, the support plate 532A may simply be slid backward from underneath the lips 460, 462 and then withdrawn upwardly when aligned with the gaps 464, 474. This may make it somewhat easier to remove (and likewise to insert) the support plate 532A from the toe binding mount 450.

FIG. 17 is a perspective view of the toe binding mount 450 that illustrates how the first and second support plates 532, 532A, respectively, may be slidably received within the toe binding mount 450.

The quick-release locking mechanism 500 may be used to lock one of the support plates (e.g., support plate 532) in the toe binding mount 450 as follows. First, the support plate 532 is slidably inserted into the channel 480 of toe binding mount 450 while the arm 512 of quick-release locking mechanism 500 is in its first, open position. Once the support plate 532 is fully inserted, the arm 512 may be rotated downwardly into its second, closed position, such that the stop 520 fits within the recess 536 in the sidewall of the support plate 532 (or contacts the back edge 538A of the support plate 532A). In this fashion, the stop 520 prevents the support plate 532 (or 532A) from sliding backward out of the channel 480 formed by the grooves 466, 476, thereby firmly locking the support plate 532 with the toe binding 430 thereon in place within the toe binding mount 450. The support plate 532 may quickly and easily be removed by rotating the arm 512 of the quick-release locking mechanism 500 upwardly to its first, open position, and then sliding the support plate 532 rearwardly out of the toe binding mount 450.

While FIGS. 14A-14D illustrate one exemplary quick-release locking mechanism, it will be appreciated that numerous other mechanism could be used. Any appropriate toe bindings may be mounted on the support plates 532, 532A such as, for example, the toe bindings 130 and 130A depicted in FIGS. 6A and 6B, respectively.

FIGS. 18A-18H are perspective views of the ski system 400 that illustrate how the toe binding mount 450 and the quick-release locking mechanism 500 allow for a user to quickly and easily replace the first toe binding 130 with the second toe binding 130A.

Figure 18A:
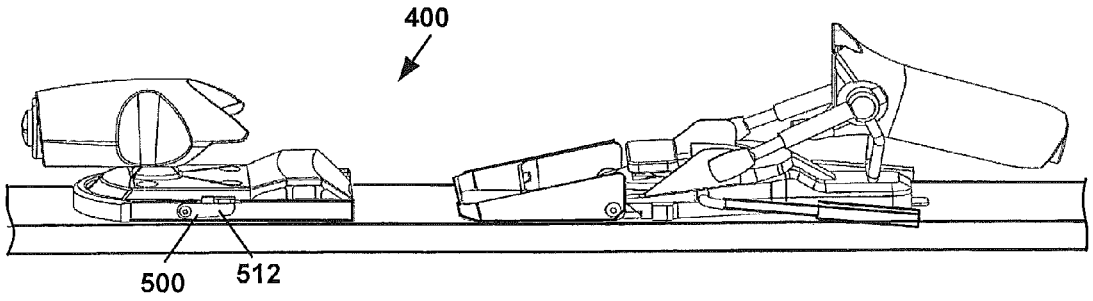
FIGS. 18A-18H are perspective views of the ski system of FIG. 12 that illustrate how a first toe binding thereof may be quickly and easily replaced with a second toe binding.
Figure 18B:
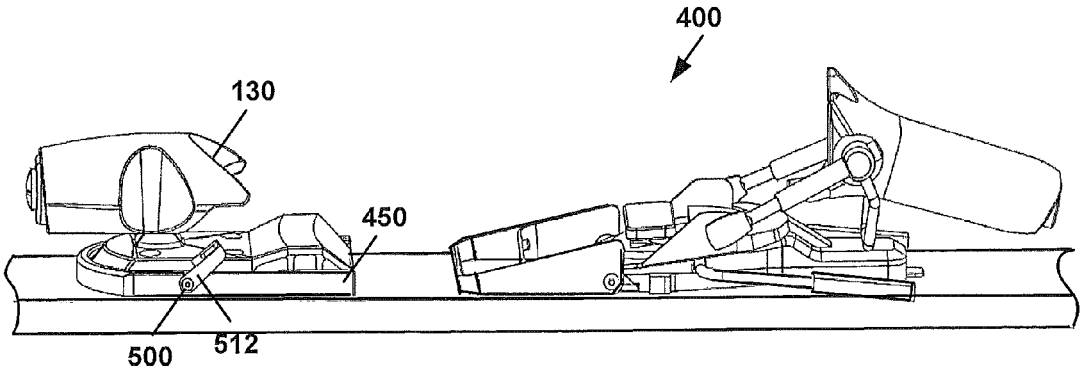
Figure 18C:
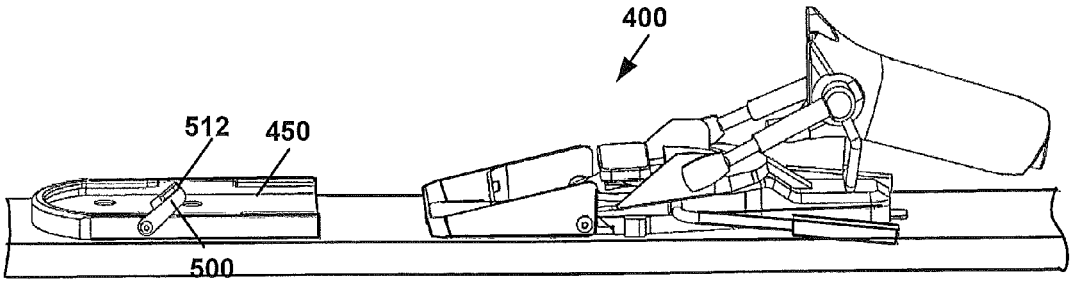

FIG. 18A illustrates the ski system 400 with the toe binding 130 locked into place within the toe binding mount 450 (note that the arm 512 of quick-release locking mechanism 500 is in its second, closed position), and with the ski boot 50 removed. As shown in FIG. 18B, the toe binding replacement operation may begin with a user moving the arm 512 to its first, open position. As shown in FIG. 18C, once the arm 512 is moved to its open position, the support plate 532 with the toe binding 130 mounted thereon may be slid rearwardly out of the toe binding mount 450.

Figure 18D:
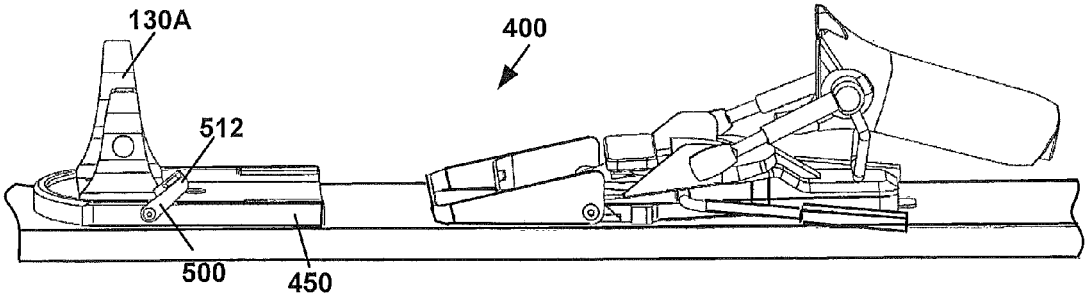
Figure 18E:
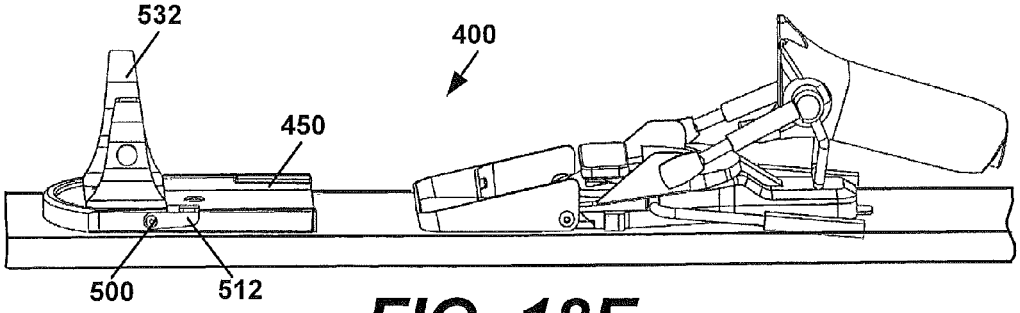
Figure 18F:
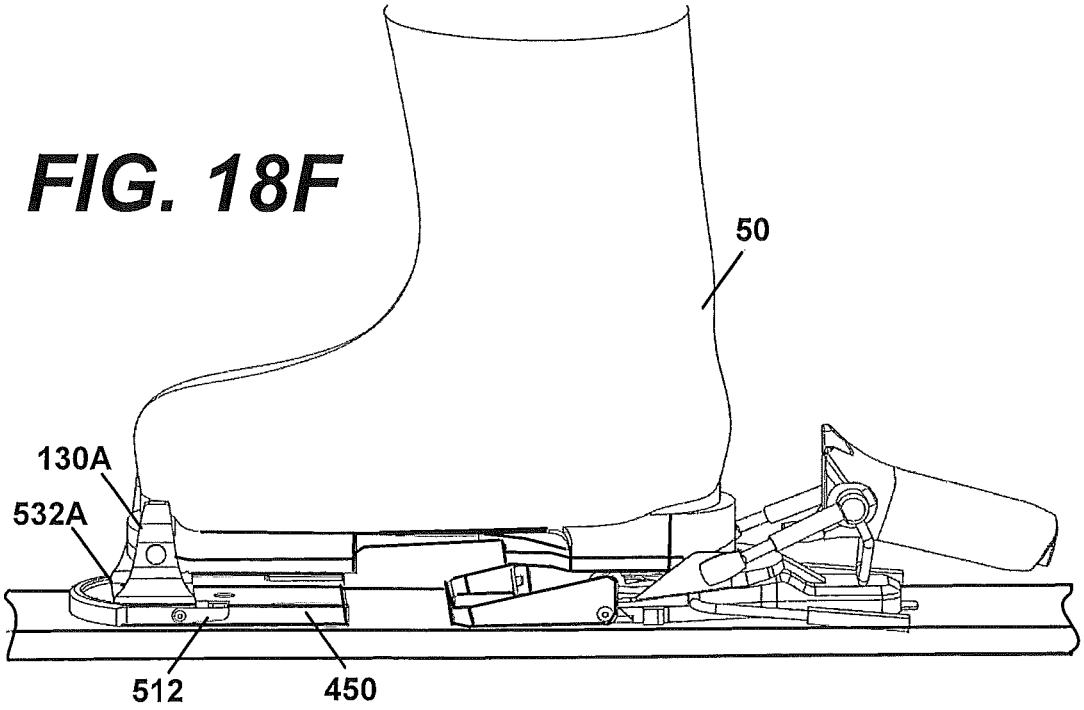
Figure 18G:
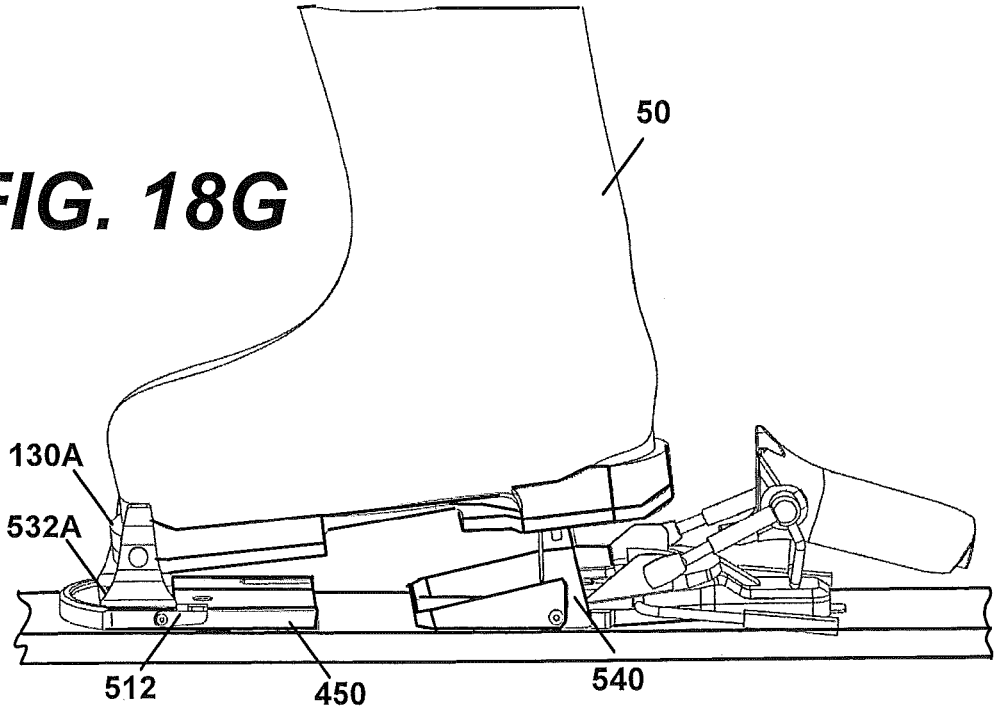
Figure 18H:
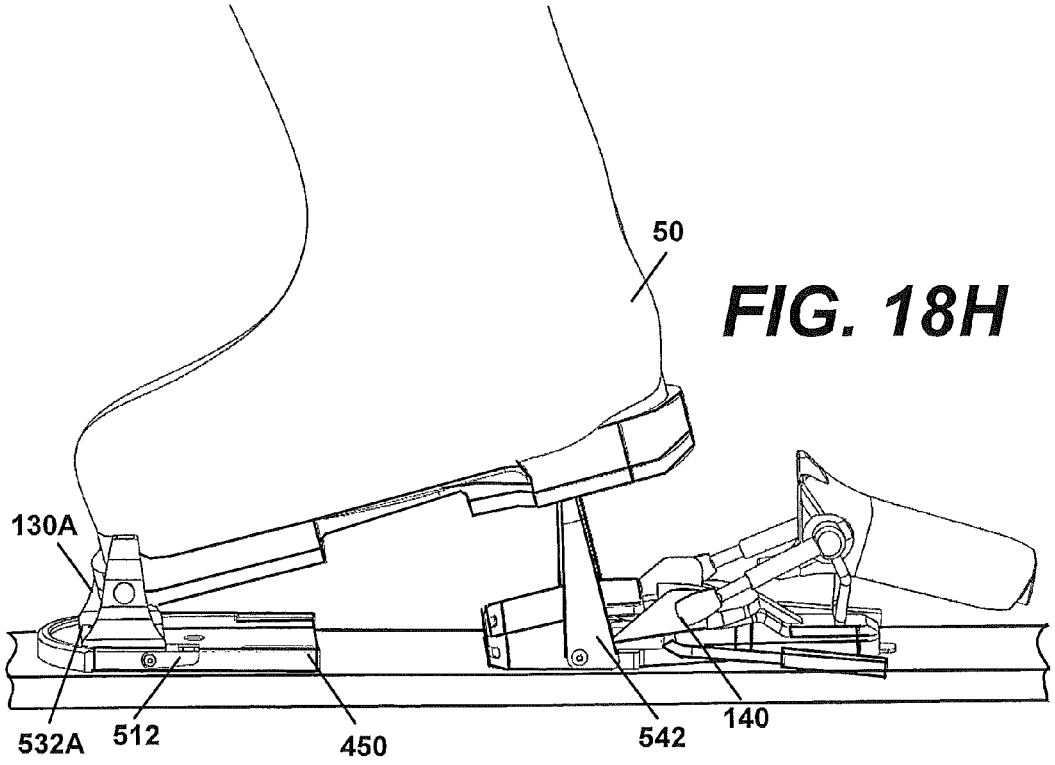

Next, as shown in FIG. 18D, the support plate 532A with toe binding 130A mounted thereon may be slid into the toe binding mount 450. As shown in FIG. 18E, the arm 512 of the quick-release locking mechanism 500 may then be rotated downwardly into its second, closed position in order to lock the support plate 532A (and hence toe binding 130A) in place within the toe binding mount 450. Next, as shown in FIG. 18F, the ski boot 50 may be mounted in the toe binding 130A. Finally, as shown in FIGS. 18G and 18H, two different climbing bails 540, 542 are included as part of the heel binding 140. One or the other of the climbing bails 540, 542 may be rotated upwardly to raise the heel of the ski boot 50 to a more comfortable position for a skier ascending a mountain. Notably, all of the above steps may be completed by hand without the use of any tools.

FIGS. 19-23 illustrate a toe binding mount 600 and associated equipment according to still further embodiments of the present invention. In particular, FIGS. 19A-19C are a perspective view, a plan view and a side view, respectively, of the toe binding mount 600. FIGS. 20A-20C are a perspective view, a plan view and a top view, respectively, of a first support plate 632 that may be used in conjunction with the toe binding mount 600. FIGS. 21A-21C are a perspective view, a plan view and a top view, respectively, of a second support plate 632A that may be used in conjunction with the toe binding mount 600. FIG. 22A is a perspective view of the support plate 532 with the toe binding 130 mounted thereon. FIG. 22B is a perspective view of the support plate 532A with the toe binding 130A mounted thereon. Finally, FIGS. 23A-23F are perspective views illustrating the use of the toe binding mount 600.

Figure 19A:
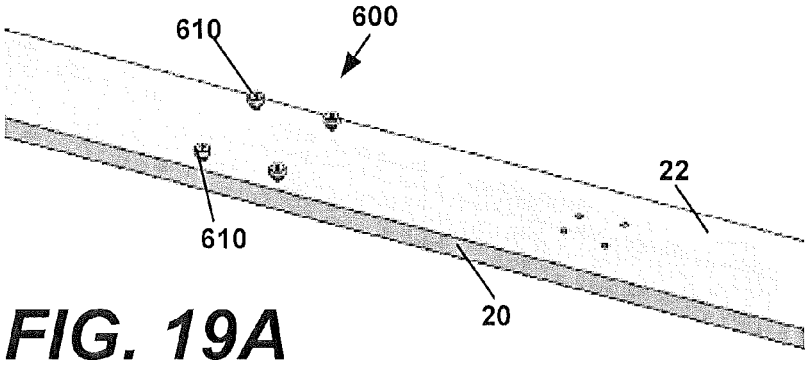
FIGS. 19A-19C are a perspective view, a plan view and a side view, respectively, of a toe binding mount according to still further embodiments of the present invention.
Figure 19B:
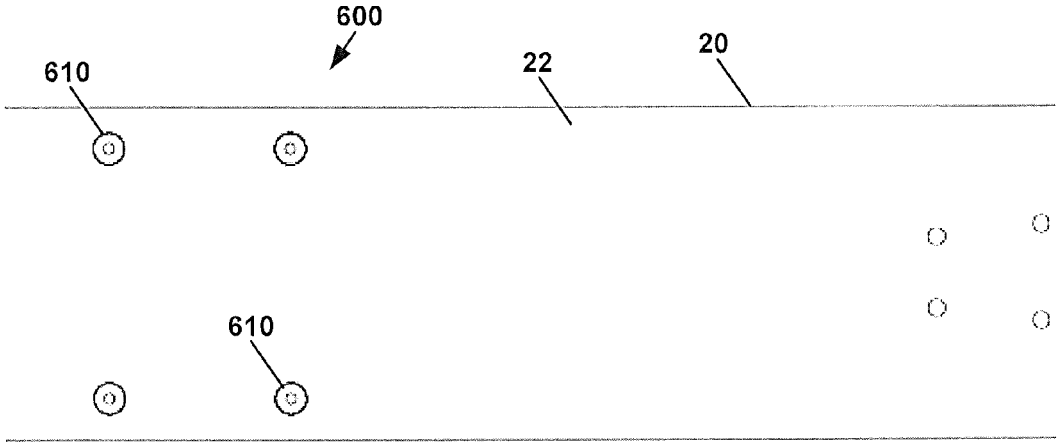
Figure 19C:
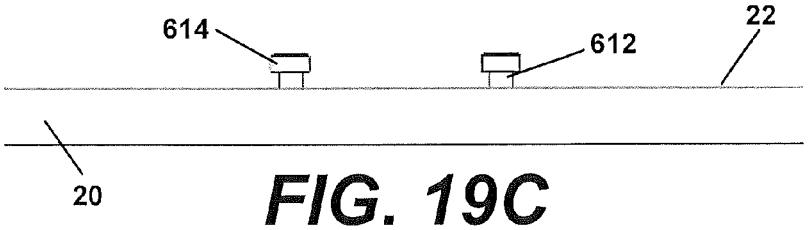
Figure 20B:
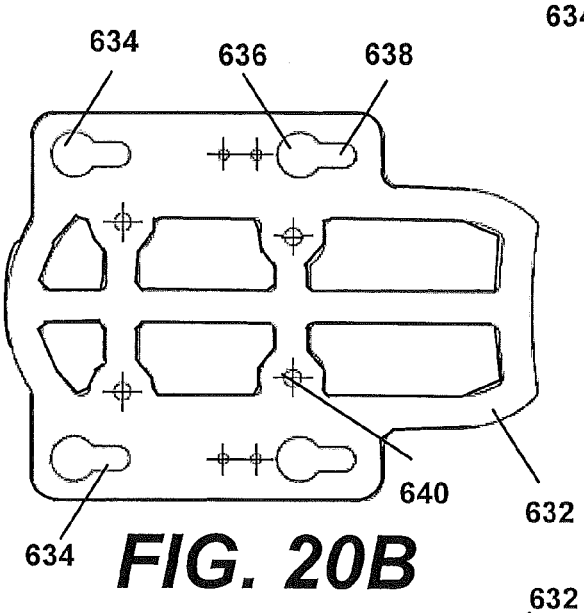
FIGS. 20A-20C are a perspective view, a plan view and a top view, respectively, of a first support plate that may be used in conjunction with the toe binding mount of FIGS. 19A-19C.
Figure 20A:
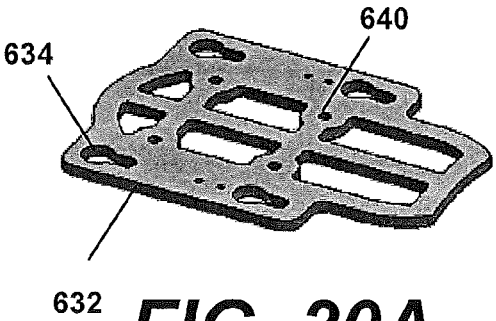
Figure 20C:
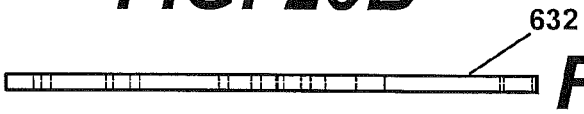
Figure 21B:
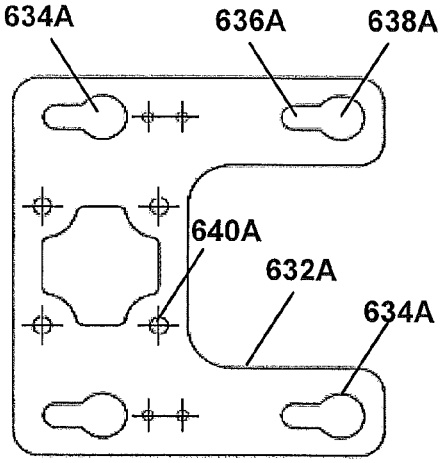
FIGS. 21A-21C are a perspective view, a plan view and a top view of a second support plate that may be used in conjunction with the toe binding mount of FIGS. 19A-19C.
Figure 21A:
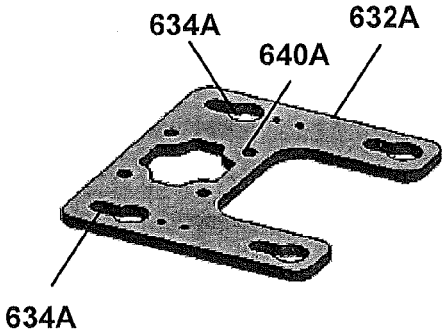
Figure 21C:
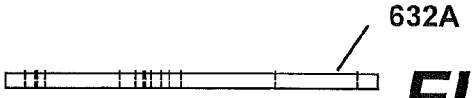

As shown in FIGS. 19A-19C, the toe binding mount 600 may simply comprise four bolts 610 that are mounted on a top surface 22 of the ski 20. The bolts 610 may be aligned in, for example, two rows on the ski 20, although other configurations (and other numbers of bolts 610) are possible. Each bolt 610 may have a shank portion 612 and a head 614. As shown best in FIG. 19C, the shanks 612 of each bolt 610 may not be inserted all of the way into the top surface 22 of the ski 20, and thus the head 614 of each bolt may be positioned a small distance above the top surface 22 of the ski 20. This small distance may slightly exceed the thickness of the support plates 632, 632A (see FIGS. 20-21) that are used in conjunction with the toe binding mount 600, as will become apparent from the discussion that follows.

Figure 22A:
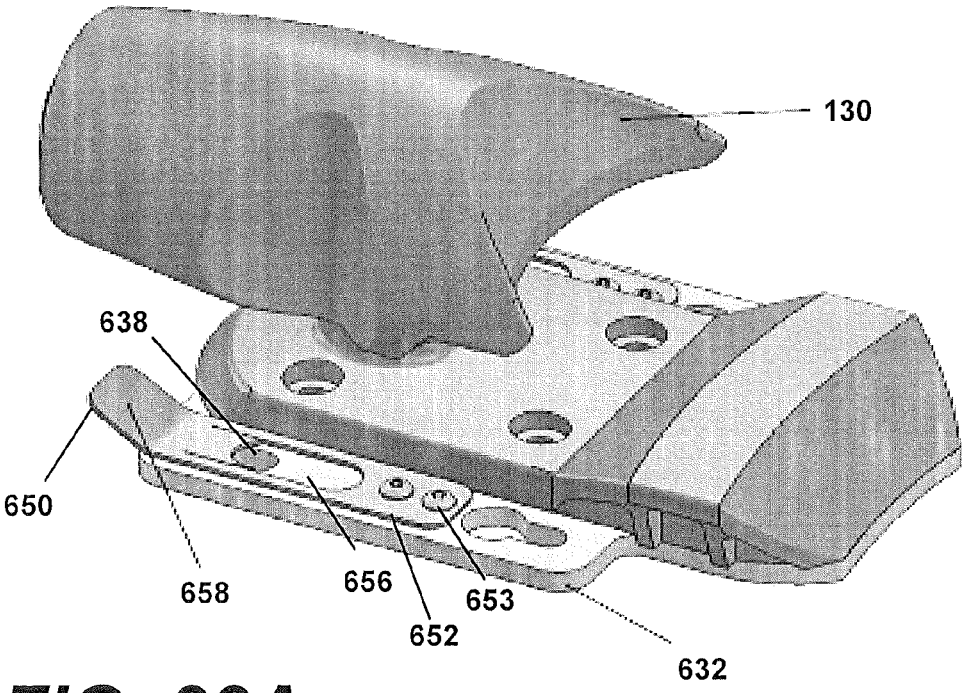
FIGS. 22A-22B are perspective views of the support plates of FIGS. 20A-20C and FIGS. 21A-21C, respectively, with toe bindings mounted thereon.

Turning next to FIGS. 20A-20C and FIG. 22A, a first support plate 632 is provided which may be mounted on the toe binding mount 600. The first support plate 632 includes a plurality of apertures 640. As shown in FIG. 22A, the alpine toe binding 130 may be mounted on a top surface of the support plate 632 via a plurality of screws (not visible) which are received in the apertures 640 of support plate 632. Referring again to FIGS. 20A-20C, it can be seen that the support plate 632 also includes four additional apertures 634. Each aperture 634 includes a receiving portion 636 and a lock portion 638.

Figure 22B:
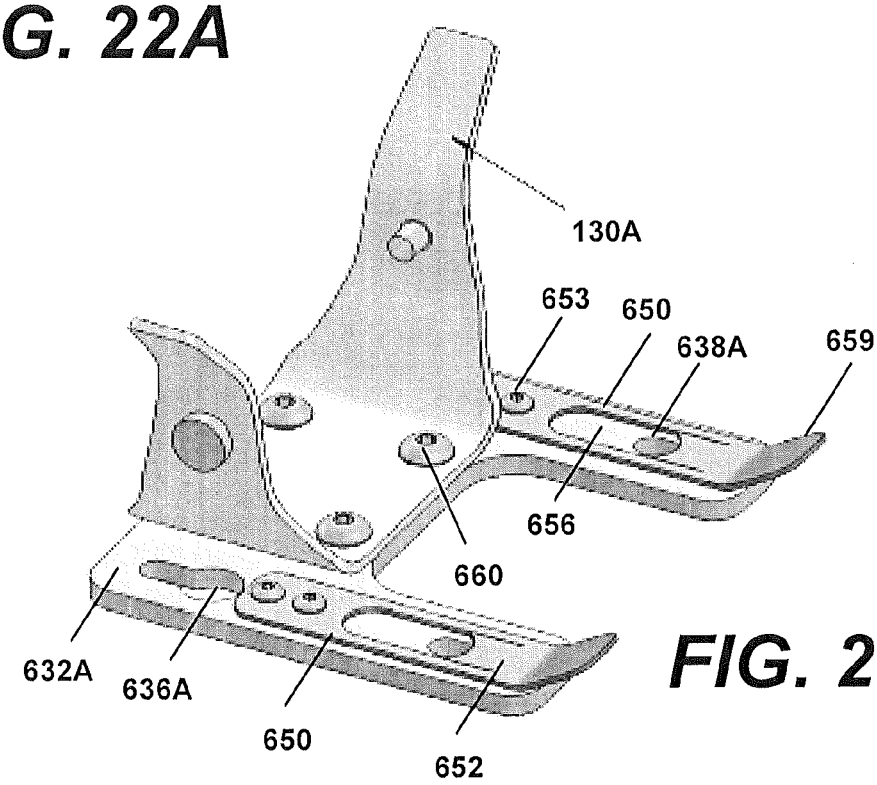

As shown in FIGS. 21A-21C and FIG. 22B, a second support plate 632A is provided which also may be mounted on the toe binding mount 600. The second support plate 632A includes a plurality of apertures 640. As shown in FIG. 22B, the touring toe binding 130A may be mounted on a top surface of the support plate 632A via a plurality of screws 660 which are received in the apertures 640A of support plate 632A. Referring again to FIGS. 21A-21C, it can be seen that the support plate 632A also includes four additional apertures 634A. Each aperture 634A includes a receiving portion 636A and a lock portion 638A.

The way in which the support plate 632 may be mounted onto the toe binding mount 600 will now be described with reference to FIGS. 19A-19C, FIGS. 20A-20C and 22A. First, the support plate 632 may be placed above the toe binding mount 600 with the four bolts 610 of the toe binding mount 600 aligned with the receiving portions 636 of the four apertures 634 of the support plate 632. The support plate 632 may be pressed down onto the top surface 22 of the ski 20 so that the heads 614 of the four bolts 610 are received through the receiving portions 636 of the respective apertures 634. The support plate 632 may then be slid forwardly so that the bolts 610 are moved into the locking portion 638 of the respective apertures 634.

As shown in FIG. 22A, a pair of quick-release locking mechanisms 650 are mounted on the support plate 632. Each quick-release locking mechanism 650 may comprise an elongated metal strip 652 that has a base 654 and a distal end 658. The base 654 of the strip 652 includes a pair of apertures (not visible), and a pair of screws 653 are inserted through the respective apertures in order to mount the quick-release locking mechanism 650 on an upper surface of the support plate 632. A middle portion of the metal strip 652 includes an elongated aperture 656 that has a width that is greater than a width of the heads 614 of the bolts 610 of the toe binding mount 600. The distal end 658 of the quick-release mechanism 650 is bent upwardly to form a tab 659 that a user may grasp to unlock the quick-release locking mechanism 650 in order to remove the support plate 632 from the toe binding mount 600 in the manner described below.

When the support plate 632 is inserted onto the toe binding mount 600, the quick release locking mechanisms 650 each partially cover one of the apertures 634. In particular, as shown in FIG. 22A, each quick-release locking mechanism 650 only exposes the locking portion 638 of the aperture 634, and covers up the receiving portion 636 of the aperture 634. When the support plate 632 is pressed downwardly onto the four bolts 610, each bolt 610 is received within the receiving portion 636 of a respective one of the apertures 634. As the quick-release locking mechanism 650 is only bolted to the ski 20 at its base 654, the head 614 of the bolt 610 may push the distal end 658 of the quick-release locking mechanism 650 upwardly (as the metal strip 652 will resiliently bend upward), allowing the head 614 of each bolt 610 to extend through its respective aperture 634. When the support plate 632 is then pushed forwardly, the four bolts 610 move from the receiving portions 636 of their respective apertures 634 into the locking portions 638 of their respective apertures 634. Once the bolts 610 are fully within the locking portions 638 of their respective apertures 636, the distal end 658 of the quick-release locking mechanism 650 will clear the bolt 610, and the metal strip 652 will then resiliently snap downward to cover the receiving portion 636. Once this occurs, the bolt 610 is locked within the aperture 634, and the support plate 632 is thus locked into the toe binding mount 600.

In order to remove the support plate 632 from the toe binding mount 600, a user may merely grasp the tab 659 on each quick-release locking mechanism 650 and pull the distal end 658 thereof upwardly, while at the same time sliding the support plate 632 backwardly. Since the user has pulled the distal end 658 of each quick-release locking mechanism 650 upwardly and out of the way, the heads 614 of the bolts 610 of the toe binding mount 600 may move from the locking portion 638 of each respective aperture 634 to the receiving portion 636 thereof. As the diameter of the receiving portion 636 of each aperture 634 exceeds the diameter of the head 614 of each bolt, the support plate 632 may then be lifted upwardly off of the bolts 610. Thus, once again the toe binding mount 600 and the quick-release locking mechanism 650 provide a quick and easy way for a user to install and remove a toe binding from a ski without the use of any tools.

It will be appreciated that the support plate 632A may be mounted onto the toe binding mount 600 in the exact same manner, and hence further description of the technique that may be used to mount the support plate 632 on toe binding mount 600 will be omitted.

FIGS. 23A-23F illustrate the operations that may be performed in order to quickly and easily replace a first toe binding 130 with a second toe binding 130A using the toe binding mount 600 and the quick-release locking mechanism 650 of FIGS. 19-22.

Figure 23A:
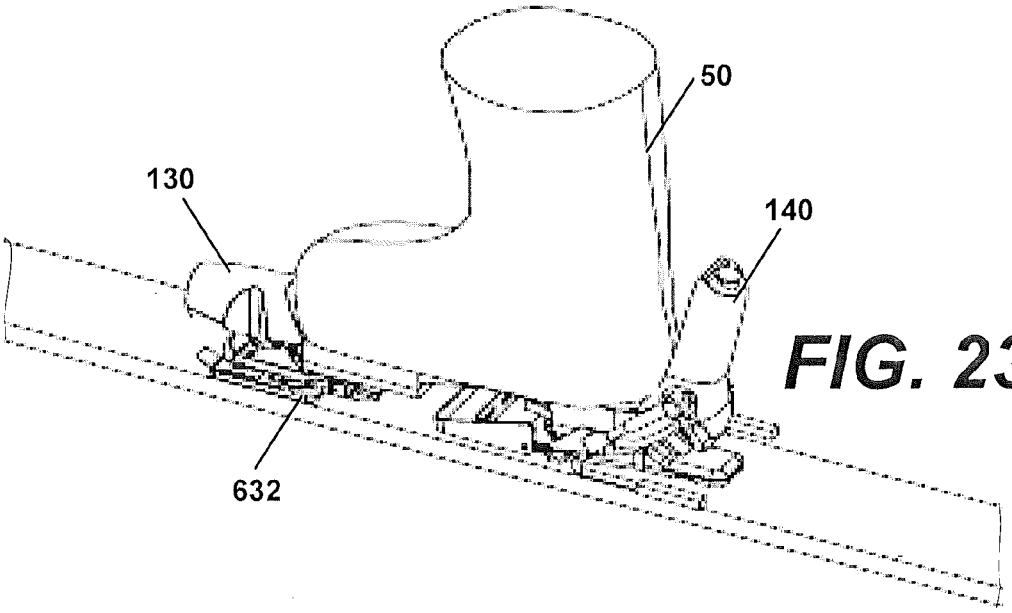
FIGS. 23A-23F are perspective views illustrating the use of the toe binding mount of FIGS. 19A-19C.
Figure 23B:
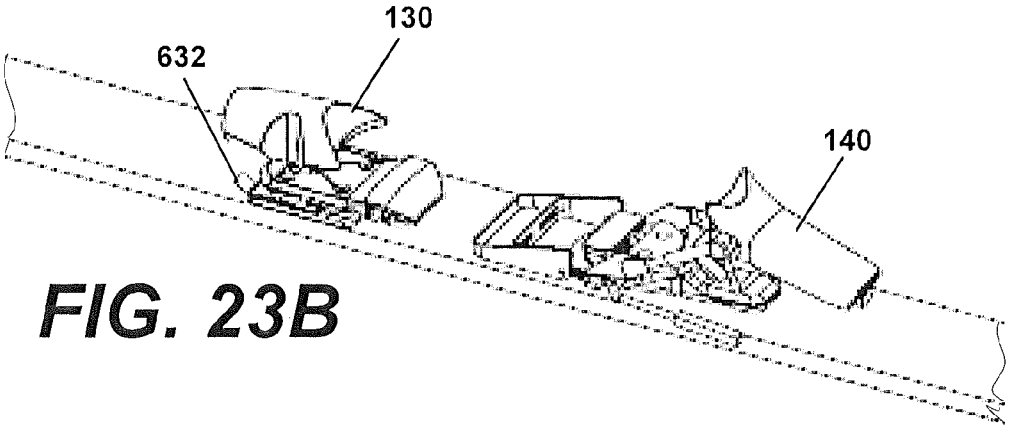
Figure 23C:
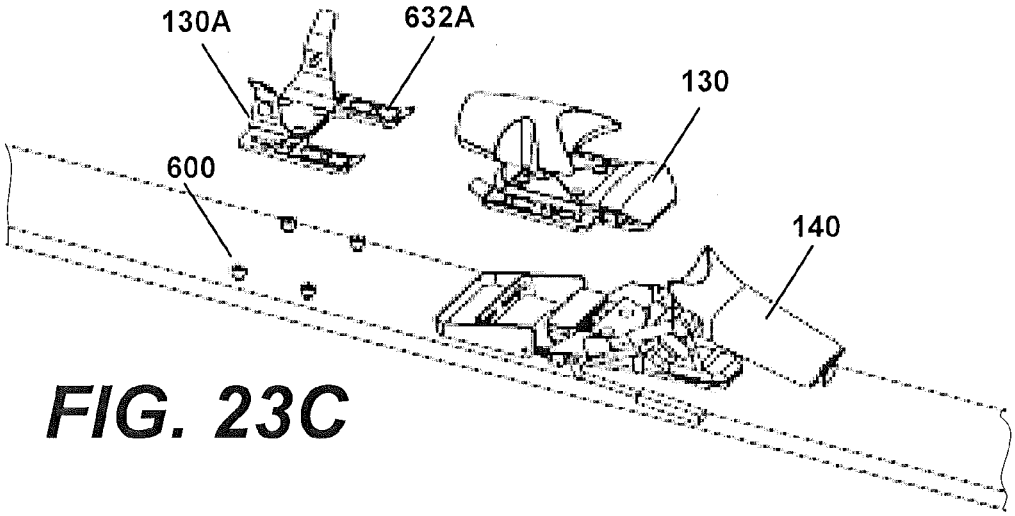

As shown in FIG. 23A, operations may begin with a first support plate 632 that has a first toe binding mount 130 mounted thereon received within the toe binding mount 600, and a boot 50 mounted between the toe binding 130 and the heel binding 140. Referring to FIG. 23B, the boot 50 may then be removed. As shown in FIG. 23C, once the boot 50 is removed, the toe binding 130 may be detached from the toe binding mount 600, and a second support plate 632A that has a second toe binding 130A mounted thereon may be aligned above the toe binding mount 600.

Figure 23D:
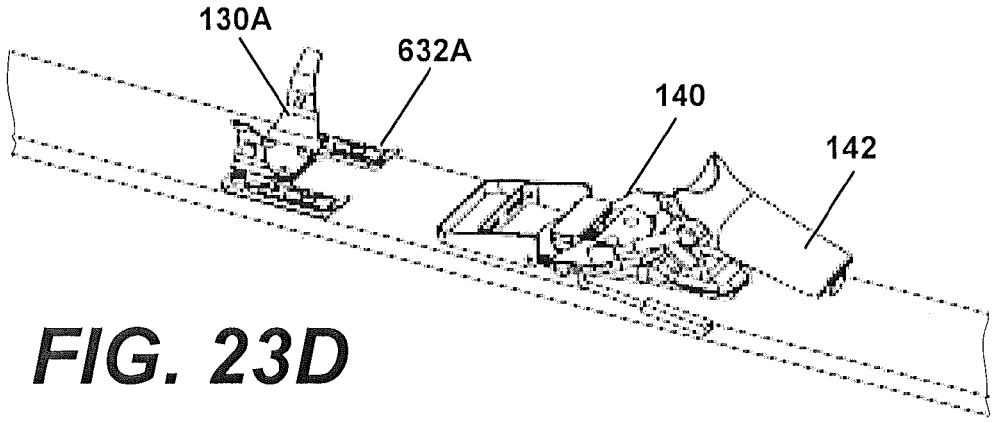
Figure 23E:
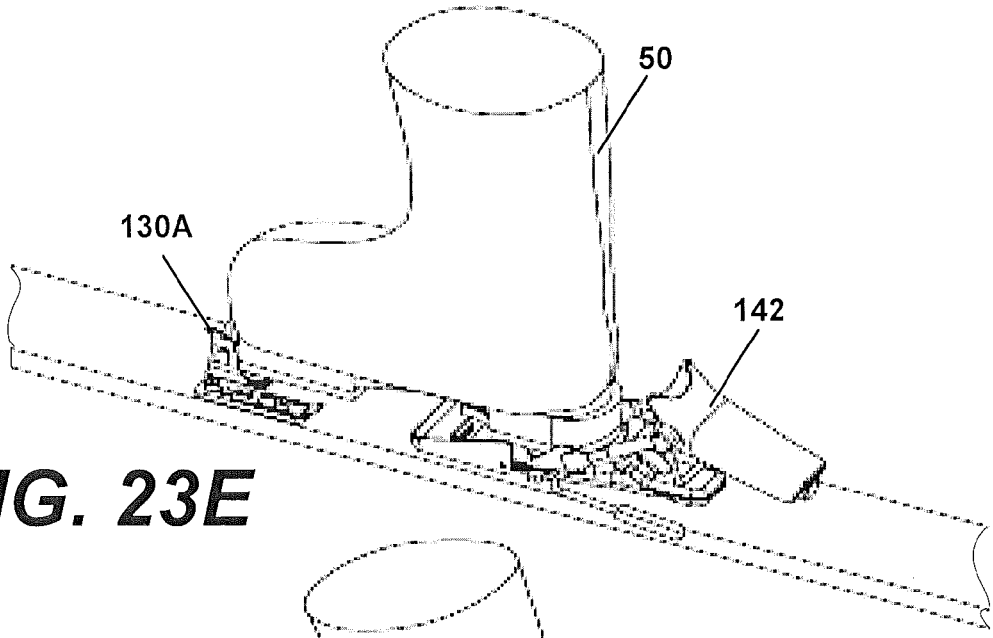
Figure 23F:
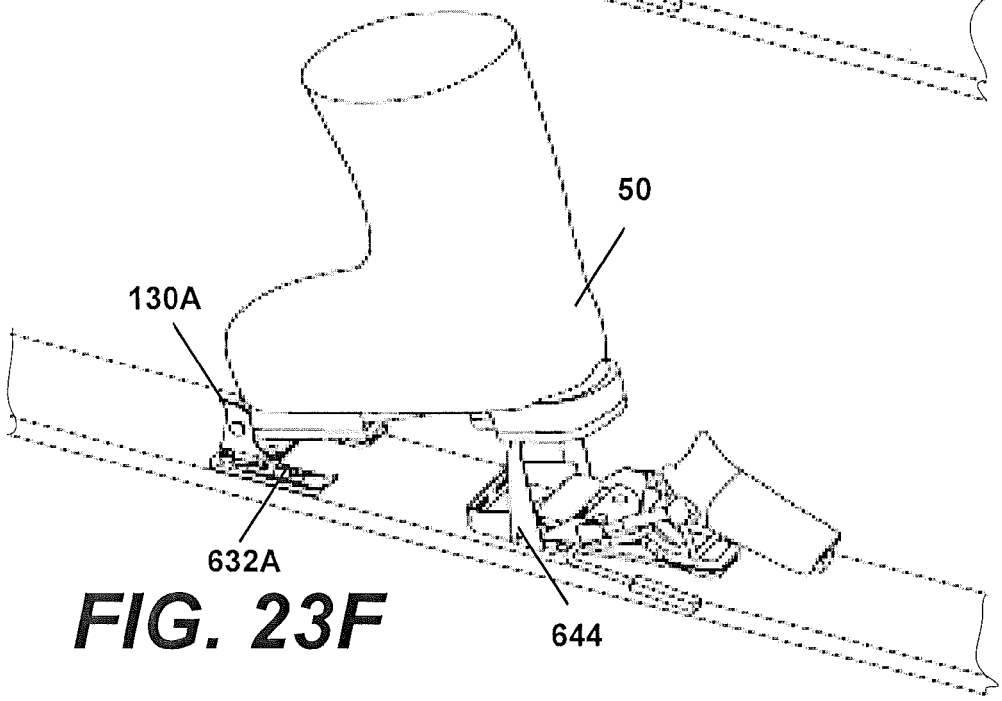

As shown in FIG. 23D, the second support plate 632A (with the second toe binding 130A thereon) may then be inserted over the four bolts 610 of the toe binding mount 600 and slid rearwardly so that it is locked into place within the toe binding mount 600. Referring to FIG. 23E, the ski boot 50 may then be inserted between the toe binding 130A and the heel binding 140. Finally, the climbing bail 644 may be rotated into place.

The toe binding mounts according to embodiments of the present invention may be formed out of, for example, a light, strong metal such as aluminum or titanium or alloys thereof. However, it will be appreciated that various other metals or metal allows could be used, as could other materials such as carbon composite materials or strong, rigid plastic materials.

While the present invention has been described above with reference to exemplary embodiments thereof, it will be appreciated that many modifications may be made to these exemplary embodiments without departing from the scope of the present invention. By way of example, the toe binding mounts 150 and 250 described above could be turned 180 degrees and then mounted on ski 120 so that the support plates 132, 132A or 232, 232A would be slidably received in the toe binding mounts 150, 250 from the front of the ski 120 instead of from the rear of the ski 120. In other embodiments, a rear wall and rear lip could be provided on the toe binding mount 150 and one of the sidewalls could be removed so that the support plates are slidably received in the toe binding mount from the side of the ski. In such embodiments, the quick-release locking mechanism would be moved so that the lock pin extends in the longitudinal direction along one side of the toe binding mount. In still further embodiments, the shapes of the lips could be modified and/or the lip that extends inwardly from the front wall could be omitted.

It will likewise be appreciated that the quick-release locking mechanisms such as the pin 210 and latch piece 220 or the spring clips 320 may be replaced with other quick-release mechanisms. As one example, the latch piece 220 could be omitted and a different locking mechanism could be provided on the end of the locking pin 210. In other embodiments, the locking pin 210 could be replaced with a spring-loaded support that can be moved into place in the rear end of the channel 172 to lock one of the support plates 132, 132A in place within the toe binding mount 150. Numerous other locking mechanisms could also be used.

It will also be appreciated that heel binding mounts may also be provided according to further embodiments of the present invention that allow for the quick and easy replacement of a heel binding. In particular, each of the above-described toe binding mounts could also be used as a heel binding mount.

The present invention has been described above with reference to the accompanying figures. The invention is not limited to the illustrated embodiments; rather, these embodiments are intended to fully and completely disclose the invention to those skilled in this art. In the figures, like numbers refer to like elements throughout. Thicknesses and dimensions of some components may be exaggerated for clarity.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Herein, the terms "attached", "connected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A ski system, comprising:

a ski having a top surface and a bottom surface;

a heel binding provided on the top surface of the ski;

a toe binding mount provided on the top surface of the ski forward of the heel binding, the toe binding mount including a first sidewall that extends upwardly above the ski and a first lip that extends inwardly from the first sidewall, and a second sidewall that extends upwardly above the ski and a second lip that extends inwardly from the second sidewall toward the first sidewall, the first and second sidewalls being generally opposed from each other and defining a channel therebetween;

a toe binding that includes a support plate, the support plate configured to be slidably received within the channel of the toe binding mount between the top surface of the ski and the first and second lips and to be releasably mounted to the toe binding mount, wherein a bottom surface of the support plate is coplanar with inner lower edges of the first and second sidewalls of the toe binding mount;

a quick-release locking mechanism for locking the support plate of the toe binding within the toe binding mount, wherein the quick-release locking mechanism is configured for release by hand.

2. The ski system of claim 1, wherein the quick-release locking mechanism comprises a lock pin that is received within first and second apertures that extend through the respective first and second sidewalls, wherein the lock pin is configured to hold the support plate within the toe binding mount.

3. The ski system of claim 1, wherein the quick-release locking mechanism comprises a rotatable stop.

4. The ski system of claim 1, wherein the quick-release locking mechanism comprises at least one hand-activated clip.

5. The ski system of claim 1, wherein the first and second sidewalls are angled with respect to each other.

6. The ski system of claim 1, further comprising a riser plate that is provided between the top surface of the ski and the heel binding.

7. A ski system, comprising:

a ski having a top surface and a bottom surface;

a heel binding provided on the top surface of the ski;

a toe binding mount provided on the top surface of the ski forward of the heel binding, the toe binding mount including a first sidewall that extends upwardly above the ski and a first lip that extends inwardly from the first sidewall, and a second sidewall that extends upwardly above the ski and a second lip that extends inwardly from the second sidewall toward the first sidewall, the first and second sidewalls being generally opposed from each other and defining a channel therebetween;

a first free-pivoting toe binding that is suitable for use in ascending mountains, the first free-pivoting toe binding configured to be releasably mounted to the toe binding mount the first free-pivoting toe binding including a first support plate, the first support plate configured to be slidably received within the channel of the toe binding mount between the top surface of the ski and the first and second lips, wherein a bottom surface of the first support plate is coplanar with inner lower edges of the first and second sidewalls of the toe binding mount;

a second alpine toe binding that is suitable for descending mountains, the second alpine toe binding also configured to be releasably mounted to the toe binding mount, the second free-pivoting toe binding including a second support plate that is separate from the first support plate, the second support plate configured to be slidably received within the channel of the toe binding mount between the top surface of the ski and the first and second lips, wherein a bottom surface of the second support plate is coplanar with inner lower edges of the first and second sidewalls of the toe binding mount;

a quick-release locking mechanism that is configured to lock one of the first free-pivoting toe binding or the second alpine toe binding at a time within to the toe binding mount, wherein the quick-release locking mechanism includes at least one release mechanism that is configured for release by hand.

8. The ski system of claim 7, wherein the release mechanism comprises a removable lock pin.

9. The ski system of claim 7, wherein the first support plate mounts a jaw of the first free-pivoting toe binding farther forward on the ski than the second support plate mounts a jaw of the second alpine toe binding.

10. The ski system of claim 7, wherein the first support plate includes a plurality of apertures that are aligned with a plurality of apertures included on a bottom surface of the first free-pivoting toe binding.

11. The ski system of claim 7, wherein the release mechanism comprises a rotatable stop.

12. The ski system of claim 7, wherein the heel binding further comprises a climbing bail.

13. The ski system of claim 1, wherein the toe binding mount further includes a base plate, and wherein the first and second sidewalls extend upwardly from respective first and second side edges of the base plate, and wherein the bottom surface of the support plate directly contacts the top surface of the base plate.

14. The ski system of claim 1, wherein the support plate has a planar bottom surface that engages a planar portion of the top surface of the ski.

15. The ski system of claim 1, wherein the toe binding mount further includes a front wall that extends upwardly above the ski.

16. The ski system of claim 15, wherein a front lip extends rearwardly from a top surface of the front wall.

17. The ski system of claim 7, wherein the toe binding mount further includes a base plate, and wherein the first and second sidewalls extend upwardly from respective first and second side edges of the base plate, and wherein the bottom surface of the support plate directly contacts the top surface of the base plate.

18. The ski system of claim 7, wherein the support plate has a planar bottom surface that engages a planar portion of the top surface of the ski.

19. The ski system of claim 7 wherein the toe binding mount further includes a front wall that extends upwardly above the ski.

20. The ski system of claim 19, wherein a front lip extends rearwardly from a top surface of the front wall.

* * * * *